US008221270B1

(12) United States Patent
Kraska et al.

(10) Patent No.: US 8,221,270 B1
(45) Date of Patent: Jul. 17, 2012

(54) COMBINATION SPORTING PRACTICE ASSEMBLIES

(75) Inventors: Frank C. Kraska, Mentor, OH (US); Jamie L. Nash, Hudson, OH (US); Daniel Hladky, Bedford, OH (US); Andrew J. Hauptner, Aurora, OH (US); Michael Feeney, Chagrin Falls, OH (US); Michael Carnahan, Willoughby, OH (US); Shelby J. Buell, Medina, OH (US)

(73) Assignee: The Step2 Company, LLC, Streetsboro, OH (US)

( * ) Notice: Subject to any disclaimer, the term of this patent is extended or adjusted under 35 U.S.C. 154(b) by 200 days.

(21) Appl. No.: 12/796,271

(22) Filed: Jun. 8, 2010

Related U.S. Application Data

(60) Provisional application No. 61/185,057, filed on Jun. 8, 2009, provisional application No. 61/286,078, filed on Dec. 14, 2009.

(51) Int. Cl.
*A63B 71/02* (2006.01)

(52) U.S. Cl. ..... 473/416; 473/478; D21/702

(58) Field of Classification Search ..... 473/416, 473/447, 476, 481–483; 273/317.5; D21/305, D21/699, 700, 701; 52/39.2
See application file for complete search history.

(56) References Cited

U.S. PATENT DOCUMENTS

| | | | | | |
|---|---|---|---|---|---|
| 3,399,889 | A * | 9/1968 | Harry | 473/481 |
| 3,602,504 | A * | 8/1971 | Chapman et al. | 473/416 |
| 4,793,611 | A * | 12/1988 | Thornell | 473/483 |
| D309,170 | S * | 7/1990 | Bisch | D21/702 |
| D343,883 | S * | 2/1994 | Hall | D21/702 |
| 5,513,843 | A * | 5/1996 | Russell | 473/416 |
| 5,584,480 | A * | 12/1996 | Grimsrud | 473/416 |
| 5,613,676 | A * | 3/1997 | Connolly | 473/416 |
| 5,865,691 | A * | 2/1999 | Chen | 473/416 |
| 6,070,879 | A * | 6/2000 | Kemp | 273/317.5 |
| 6,299,570 | B1 * | 10/2001 | Lim | 482/148 |
| 7,011,310 | B2 * | 3/2006 | Rowan | 273/398 |
| 7,351,168 | B1 * | 4/2008 | Pannell | 473/476 |

* cited by examiner

*Primary Examiner* — Gene Kim
*Assistant Examiner* — M Chambers
(74) *Attorney, Agent, or Firm* — Ulmer & Berne, LLP

(57) ABSTRACT

A combination sporting practice assembly includes a stem, a first structure, a second structure, and a basketball hoop. The stem extends between first and second ends. The first and second structures are releasably engaged with the first and second ends of the stem, respectively. The basketball hoop is releasably engaged with at least one of the stem, the first structure, and the second structure. The combination sporting practice assembly is selectively reconfigurable between different configurations.

17 Claims, 20 Drawing Sheets

32629-49

6/20

COMBINATION SPORTING PRACTICE ASSEMBLIES

CROSS-REFERENCE TO RELATED APPLICATIONS

This application claims priority of each of U.S. provisional patent application Ser. No. 61/185,057, filed Jun. 8, 2009, and U.S. provisional patent application Ser. No. 61/286,078, filed Dec. 14, 2009, and hereby incorporates each of these same provisional patent applications by reference herein in their respective entireties.

TECHNICAL FIELD

The present invention relates to a combination sporting practice assembly that can be selectively reconfigurable to alternatively serve as a basketball target or goal and a football target or goal.

BACKGROUND

Sports are entertaining for children, and can be useful to teach children hand/eye coordination, teamwork, and other skills or lessons. Conventional devices are available to facilitate play of sports by children.

SUMMARY

In accordance with one embodiment, a combination sporting practice assembly comprises a stem, an upper structure, a lower structure, and a basketball hoop. The stem extends between an upper end and a lower end. The upper structure comprises a left arm, a right arm, a connection portion, and a generally central portion. The connection portion is releasably engaged with the upper end of the stem. The generally central portion is moveable with respect to the connection portion between an upward position and a downward position. The lower structure is releasably engaged with the lower end of the stem and is configured to rest upon a ground surface. The basketball hoop is releasably engaged with at least one of the upper end of the stem and the upper structure. The generally central portion defines at least a portion of a basketball backboard when the generally central portion is in the upward position. The upper structure is configured to selectively define a pair of field goal uprights.

In accordance with another embodiment, a combination sporting practice assembly comprises a structure configured for resting upon a ground surface. The combination sporting practice assembly further comprises a stem extending between an upper end and a lower end. The lower end is releasably engaged with the structure. The combination sporting practice assembly further comprises a basketball hoop and means for alternatively defining a basketball backboard and a pair of field goal uprights. The means for alternatively defining a basketball backboard and a pair of field goal uprights is releasably engaged with the upper end of the stem.

In accordance with yet another embodiment, a combination sporting practice assembly comprises a stem, a first structure, a second structure, and a basketball hoop. The stem extends between a first end and a second end. The first structure is releasably engaged with the first end of the stem. The second structure is releasably engaged with the second end of the stem. The basketball hoop is releasably engaged with at least one of the stem, the first structure, and the second structure. The combination sporting practice assembly is selectively reconfigurable between a first configuration and a second configuration. In the first configuration, one of the first structure and the second structure is configured to rest upon a ground surface, and the other of the first structure and the second structure defines a basketball backboard. In the second configuration, one of the first structure and the second structure is configured to rest upon a ground surface, and the other of the first structure and the second structure defines a pair of field goal uprights.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION

Figure 1:
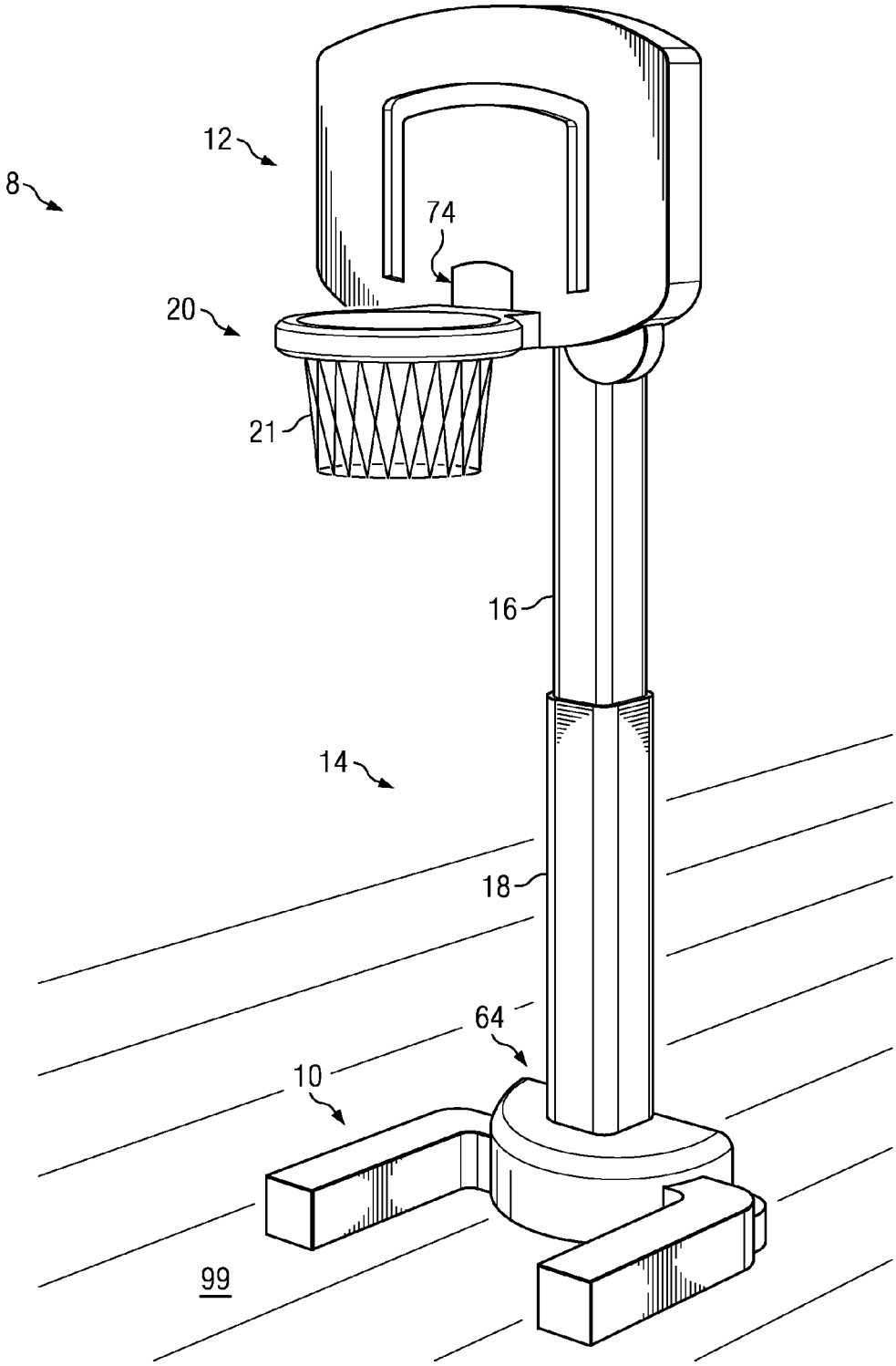
FIG. 1 is a front perspective view depicting a combination sporting practice assembly in accordance with one embodiment, wherein the combination sporting practice assembly is in a first configuration.
Figure 2:
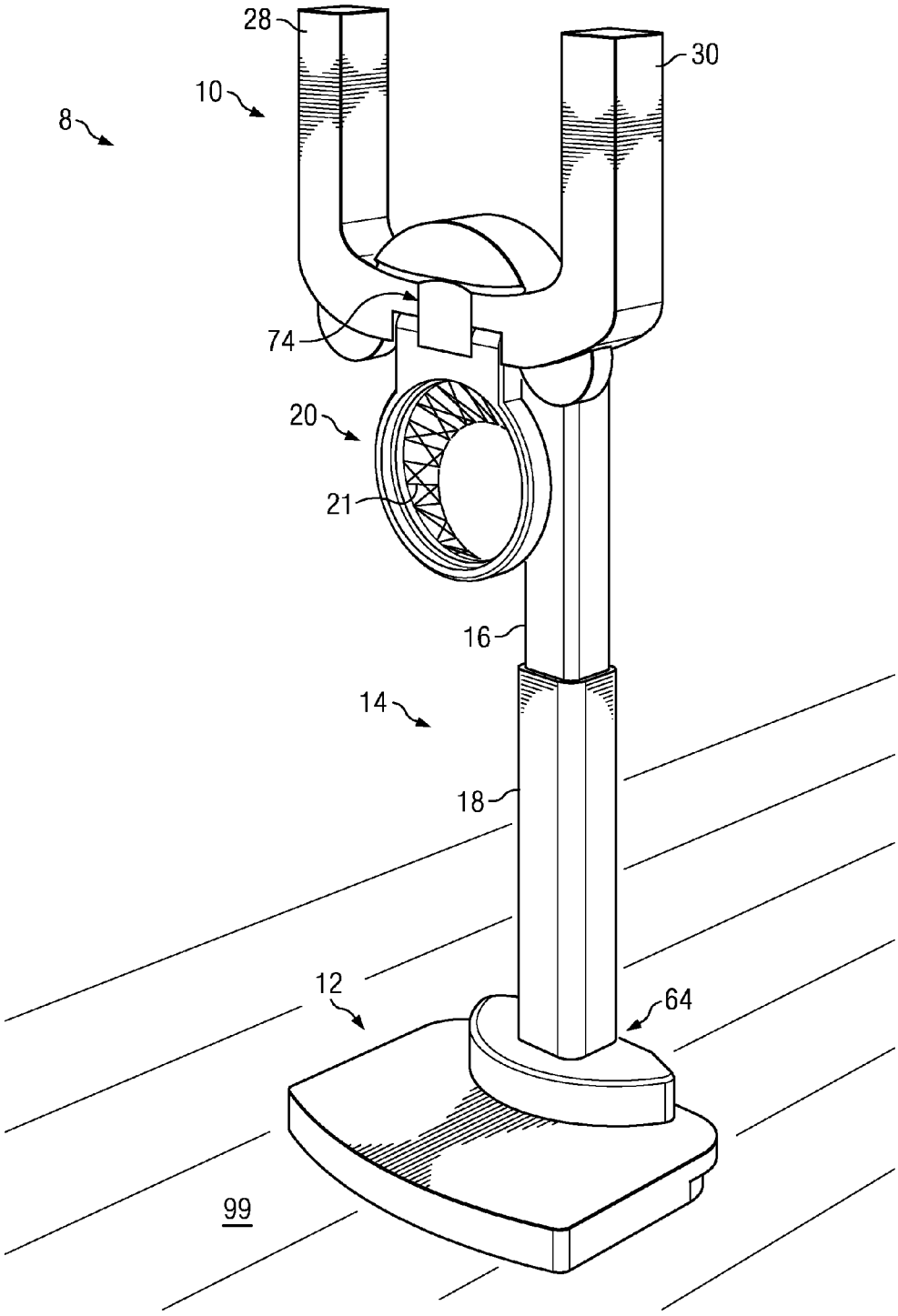
FIG. 2 is a front perspective view depicting the combination sporting practice assembly of FIG. 1, wherein the combination sporting practice assembly is in a second configuration.

Selected embodiments are hereinafter described in detail in connection with the views and examples of FIGS. 1-6, 7A-7B, 8A-8H, and 9A-9D. A combination sporting practice assembly 8 in accordance with one embodiment is depicted in FIGS. 1-2 to include structures 10 and 12, a stem 14, and a basketball hoop 20. These components can be selectively and alternatively assembled in first and second configurations. In the first configuration, as shown in FIG. 1, the combination sporting practice assembly 8 can provide a basketball target or goal. In the second configuration, as shown in FIG. 2, the combination sporting practice assembly 8 can serve as a football target or goal.

In the first configuration, as shown in FIG. 1, the structure 10 can serve as a base for resting and supporting the combination sporting practice assembly 8 upon a ground surface 99 or other outdoor or indoor support surface. In one embodiment, the structure 10 can be configured such that, when the structure 10 serves as a base for the combination sporting practice assembly 8 (as shown in FIG. 1), an interior cavity (not shown) defined by the structure 10 can be selectively filled with ballast material (e.g., water, gravel or sand) by an operator so as to resist inadvertent tipping of the combination sporting practice assembly 8 during use (e.g., as shown and described below with respect to the combination sporting practice assembly 308). When the combination sporting practice assembly 8 is disassembled, an operator can remove the ballast material from the structure 10, such as to facilitate convenient movement or storage of the combination sporting practice assembly 8.

The stem 14 is shown to comprise upper and lower riser members 16 and 18, and to extend between upper and lower ends 74 and 64. The upper riser member 16 can define the upper end 74, and the lower riser member 18 can define the lower end 64. In the first configuration, as shown in FIG. 1, the lower riser member 18 of the stem 14 can releasably engage the structure 10, and the upper riser member 16 of the stem 14 can releasably engage the structure 12.

The basketball hoop 20 can releasably engage the structure 12 and/or the upper end 74 of the stem 14. In one embodiment, the basketball hoop 20 can be selectively pivotable or detachable with respect to the structure 12 and/or the upper riser member 16 such that the basketball hoop 20 can comprise a breakaway-type basketball hoop so as to minimize the possibility that a person hanging on the basketball hoop 20 will result in collapse or toppling of the combination sporting practice assembly 8. In one embodiment, as shown in FIG. 1, the basketball hoop 20 can comprise a net 21.

In this first configuration, as shown in FIG. 1, the structure 12 can define at least a portion of a basketball backboard. In one embodiment, the upper riser member 16 can be telescopingly engaged with the lower riser member 18 and can be selectively lockable in a plurality of respective positions such that the height of the structure 12 and the basketball hoop 20 can be moved relative to the structure 10 and the ground surface 99 or other outdoor or indoor support surface, and so that the combination sporting practice assembly 8 can facilitate basketball practice by children of differing heights, ages, and athletic abilities. In one embodiment, a pin (not shown) can be provided for selective insertion into respective apertures provided by the upper and lower riser members 16 and 18 to facilitate locking of the upper and lower riser members 16 and 18 in a desired position. In another embodiment, the respective upper and lower riser members 16 and 18 can be provided with detents (e.g., similar to channels 170 shown in the embodiment of FIG. 3) and grooves (not shown) which selectively interface one another to facilitate locking of the upper and lower riser members 16 and 18 in a desired position. It will also be appreciated that, by telescopingly engaging one another, the upper and lower riser members 16 and 18 can be more conveniently and efficiently stored when the combination sporting practice assembly 8 is disassembled. In alternative embodiments, however, a stem can be formed as a unitary structure, and/or riser members of a stem might adjustably engage one another but without telescopingly engaging.

The components of the combination sporting practice assembly 8 can be selectively rearranged from the first configuration to the second configuration. In the second configuration, as shown in FIG. 2, the structure 12 can serve as a base for resting and supporting the combination sporting practice assembly 8 upon the ground surface 99 or other outdoor or indoor support surface. In the second configuration, as shown in FIG. 2, left and right arms 28 and 30 of the structure 12 can define a pair of field goal uprights to provide a football target or goal. In one embodiment, the structure 12 can be configured such that, when the structure 12 serves as a base for the combination sporting practice assembly 8, an interior cavity (not shown) defined by the structure 12 can be selectively filled with ballast material (e.g., water, gravel or sand) by an operator so as to resist inadvertent tipping of the combination sporting practice assembly 8 during use. When the combination sporting practice assembly 8 is disassembled, an operator can remove the ballast material from the structure 12, such as to facilitate convenient movement or storage of the combination sporting practice assembly 8.

In the second configuration, the lower riser member 18 of the stem 14 can releasably engage the structure 12, and the upper riser member 16 of the stem 14 can releasably engage the structure 10. The basketball hoop 20 can releasably engage the structure 10 and/or the upper riser member 16. In an embodiment in which the upper and lower riser members 16 and 18 telescopingly engage and are lockable relative to one another in multiple different positions, the height of the structure 10 and the basketball hoop 20 can be moved relative to the structure 12 and the ground surface 99 or other outdoor or indoor support surface such that the combination sporting practice assembly 8 can facilitate football practice by children of differing heights, ages, and athletic abilities. It will be appreciated that, in one embodiment, the combination sporting practice assembly 8 can be configured such that the basketball hoop 20 can be disconnected and not used when the combination sporting practice assembly 8 is in a configuration to facilitate football practice.

It will be appreciated that the removable engagement of the various components of the combination sporting practice assembly 8 can be achieved through use of any of a variety of suitable features or arrangements. For example, the structures 10 and 12 can comprise respective apertures which are sized and configured to releasably engage respective portions of the stem 14 in an interference fit, snap-fit, or otherwise. Tabs, grooves, detents, and/or other features can be provided to selectively lock various components (e.g., the stem 14 and the structures 10 and 12) of the combination sporting practice assembly 8 in engagement, such as to prevent inadvertent disassembly of the components during use of the combination sporting practice assembly 8 for basketball or football practice. It will therefore be appreciated that a stem (e.g., 14) can releasably engage a structure (e.g., 10, 12) in any of a variety of suitable configurations. Likewise, a basketball hoop (e.g., 20) can releasably engage a structure (e.g., 10, 12) and/or a stem (e.g., 14) in any of a variety of suitable configurations.

Figure 3:
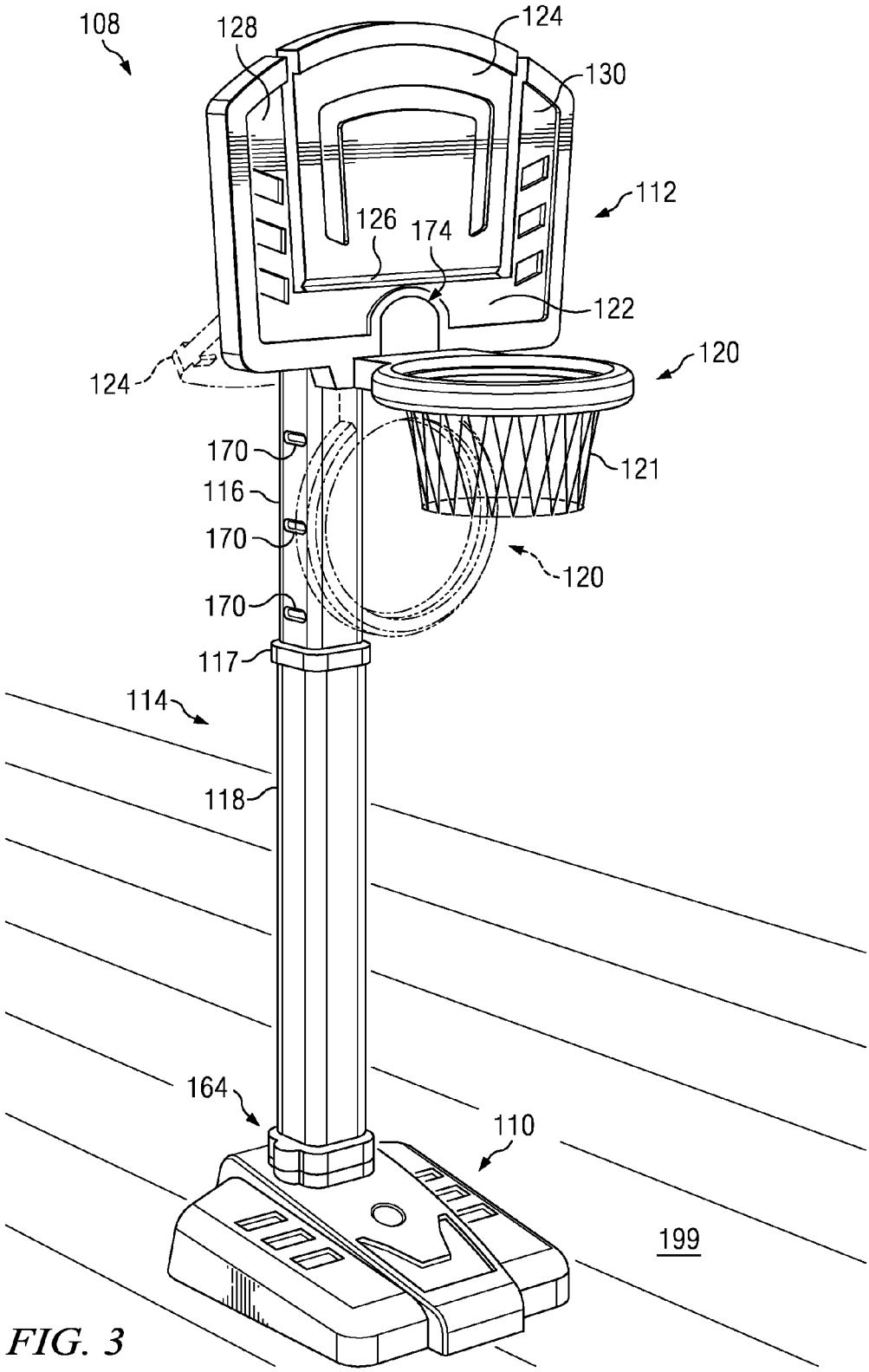
FIG. 3 is a front perspective view depicting a combination sporting practice assembly in accordance with another embodiment, wherein the combination sporting practice assembly is in a first configuration, and wherein a basketball hoop and a generally central portion of the combination sporting practice assembly are shown in solid lines in respective upward positions and are shown in dashed lines in respective downward positions.

A combination sporting practice assembly 108 in accordance with another embodiment is depicted in FIGS. 3-6 to include structures 110 and 112, a stem 114, and a basketball hoop 120 which can be selectively assembled as shown, for example, in FIG. 3. In the embodiment of FIGS. 3-6, the structure 110 is shown to comprise a lower structure, and the structure 112 is shown to comprise an upper structure. The structure 110 can serve as a base for resting and supporting the combination sporting practice assembly 108 upon a ground surface 199 or other outdoor or indoor support surface. The structure 112 can be configured to selectively and alternatively define a basketball backboard and a pair of field goal uprights.

In one embodiment, the structure 110 can include an internal cavity (not shown) which can be selectively filled with a ballast material (e.g., water, gravel or sand) by an operator so as to resist inadvertent tipping of the combination sporting practice assembly 108 during use (e.g., as shown and described below with respect to the combination sporting practice assembly 308). When the combination sporting practice assembly 108 is disassembled, an operator can remove the ballast material from the structure 110, such as to facilitate convenient movement or storage of the combination sporting practice assembly 108.

The stem 114 is shown to comprise upper and lower riser members 116 and 118, and to extend between upper and lower ends 174 and 164 provided by the respective upper and lower riser members 116 and 118. The lower riser member 118 of the stem 114 can releasably engage the structure 110, and the upper riser member 116 of the stem 114 can releasably engage the structure 112, such as described above with respect to the combination sporting practice assembly 8. The basketball hoop 120 can releasably engage the structure 112 and/or the upper riser member 116 and can be pivotable between upward and downward positions as respectively shown in solid and dashed lines in FIG. 3, respectively. It will be appreciated that the removable engagement of the various components of the combination sporting practice assembly 108 can be achieved through use of any of a variety of suitable features or arrangements, such as described above with respect to the combination sporting practice assembly 8.

In one embodiment, the stem 114 can further include a collar 117 attached to the lower riser member 118. The upper and lower riser members 116 and 118 can telescopingly engage one another and can be locked relative to one another in multiple different positions, such as through use of the collar 117 and channels 170, such that the height of the structure 112 and the basketball hoop 120 can be moved relative to the structure 110 and the ground surface 199 or other outdoor or indoor support surface, and so that the combination sporting practice assembly 108 can facilitate basketball and football practice by children of differing heights, ages, and athletic abilities, such as described above with respect to the combination sporting practice assembly 8. However, a stem can be provided in any of a variety of suitable alternative configurations.

The structure 112 can include a connection portion 122, a generally central portion 124, and left and right arms 128 and 130. In one embodiment, as shown in FIG. 3, each of the left and right arms 128 and 130 can be stationary with respect to the connection portion 122. For example, each of the left and right arms 128 and 130 can be formed as a unitary structure with the connection portion 122. The connection portion 122 can releasably engage the upper end 174 of the stem 114. Once so assembled, the structure 112 can be selectively reconfigured between first and second configurations. In particular, to facilitate such reconfiguration, the generally central portion 124 of the structure 112 can be hingedly coupled with the connection portion 122 and can be pivotable with respect to the connection portion 122 between an upward position (e.g., shown in FIG. 3) and a downward position (e.g., shown in FIG. 5, and in dashed lines in FIG. 3). In one embodiment, the generally central portion 124 can be pivotally coupled to the connection portion 122 by way of a living hinge 126. However, it will be appreciated that a generally central portion can be pivotally or otherwise movably coupled to a connection portion of a structure through use of another type of hinge, and/or in any of a variety of other suitable configurations. In still another alternative embodiment, a structure can be configured such that a generally central portion of the structure can be completely disconnected from a corresponding connection portion of the structure. For example, the generally central portion can comprise a panel which can slidingly interface channels defined by a connection portion and/or left and right arms, and which can be removed from the channels to facilitate conversion of the associated combination sporting practice assembly from a basketball practice configuration to a football practice configuration.

Figure 4:
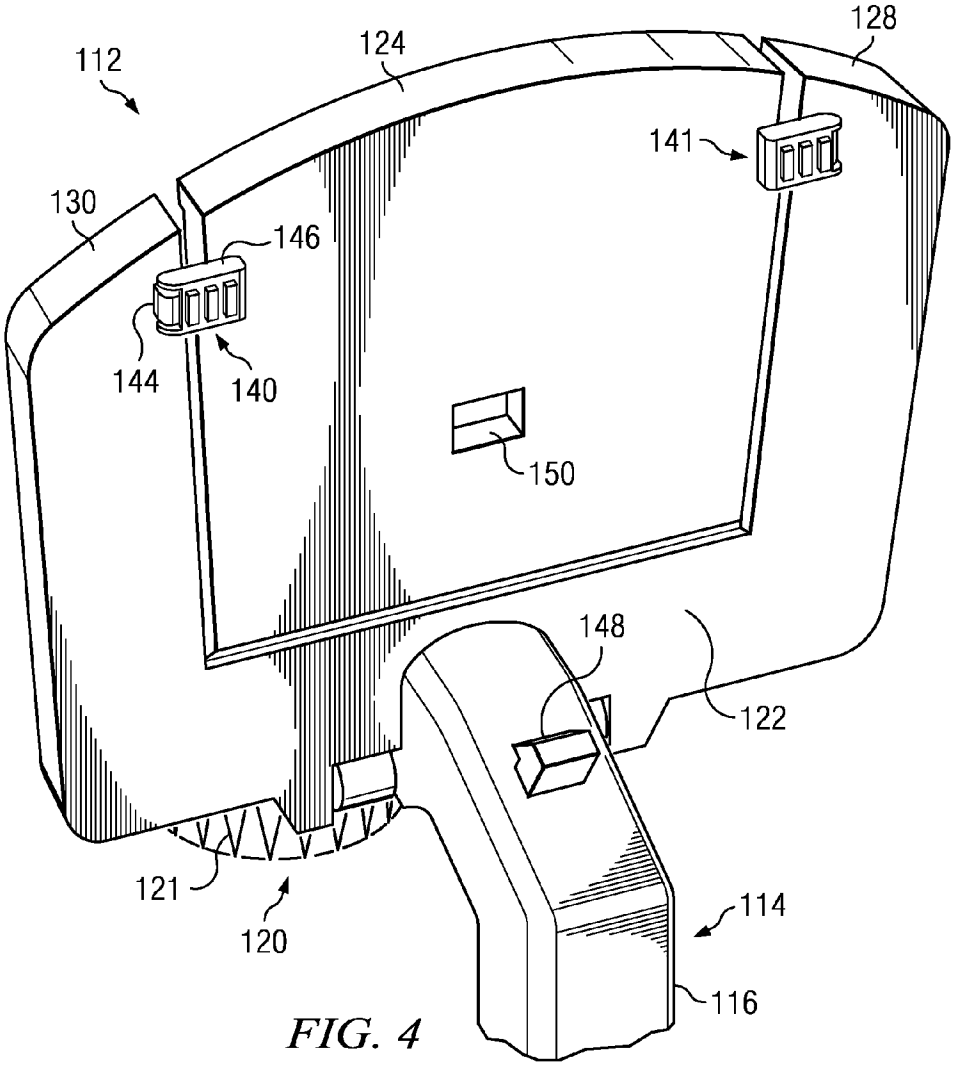
FIG. 4 is a rear perspective view depicting a portion of the combination sporting practice assembly of FIG. 3, wherein the basketball hoop and the generally central portion are shown in the respective upward positions.
Figure 5:
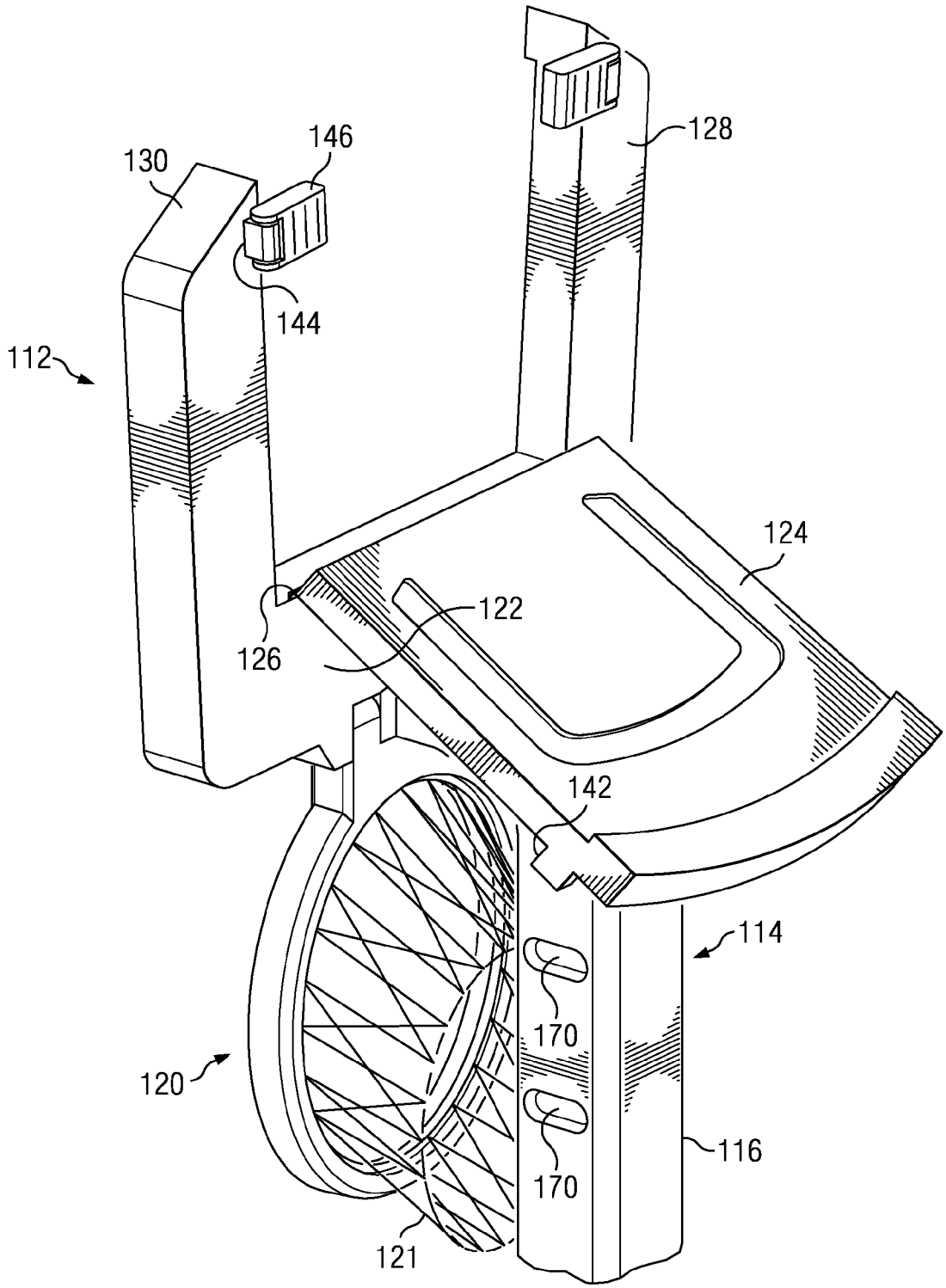
FIG. 5 is a rear perspective view depicting a portion of the combination sporting practice assembly of FIG. 3, wherein the basketball hoop and the generally central portion are shown in the respective downward positions.
Figure 6:
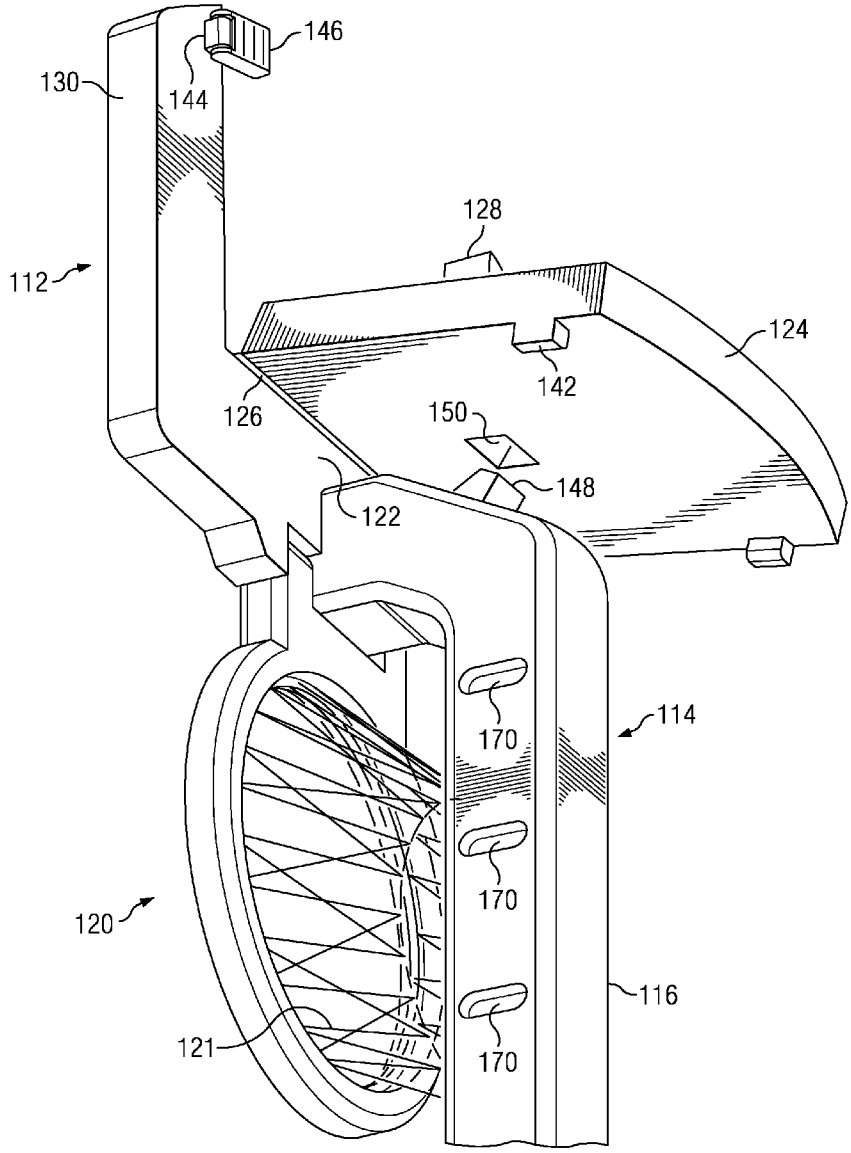
FIG. 6 is a rear perspective view depicting a portion of the combination sporting practice assembly of FIG. 3, wherein the basketball hoop is in the downward position, and wherein the generally central portion is slightly lifted from its downward position in FIG. 5.

The generally central portion 124 can be selectively locked or retained in the upward position. For example, in one embodiment, the structure 112 can include locks 140 and 141 which can be configured to selectively retain the generally central portion 124 in the upward position. The lock 140 can include a tab 142 provided on the generally central portion 124, a base 144 provided on the right arm 130, and a lever 146 moveably coupled with the base 144. The lever 146 can be injection molded from plastic or can alternatively be formed from metal or any of a variety of other suitable materials. The lever 146 can be configured to selectively engage the tab 142 in a snap-fit arrangement to facilitate securement of the generally central portion 124 in the upward position as shown in FIG. 4. The lock 141 can be similar to the lock 140 and can cooperate with the lock 140 to facilitate securement of the generally central portion 124 in the upward position as shown in FIG. 4. When the locks 140 and 141 are not engaged (as in FIGS. 5-6), the generally central portion 124 can be free to move to the downward position as shown in FIG. 5. Additional locking features (e.g., a protrusion 148 and a groove 150 as shown in FIGS. 4 and 6) can optionally be provided to facilitate selective locking or retention of the generally central portion 124 in the downward position. Any of a variety of suitable alternative locking features can be provided to selectively lock a generally central portion in one or both of an upward position and a downward position.

In the first configuration, as shown in FIG. 3, the combination sporting practice assembly 108 can provide a basketball target or goal, with the structure 112 serving as a basketball backboard and the basketball hoop 120 serving as a target opening for receiving a basketball. More particularly, the left arm 128 and the right arm 130 can each cooperate with the generally central portion 124 to define at least a portion of the basketball backboard when the generally central portion 124 is in the upward position. In one embodiment, the basketball hoop 120 can comprise a net 121, and/or can be selectively pivotable or detachable with respect to the structure 112 such that the basketball hoop 120 can comprise a breakaway-type basketball hoop so as to minimize the possibility that a person hanging on the basketball hoop 120 will result in collapse or toppling of the combination sporting practice assembly 108. In the second configuration, when the generally central portion 124 is in the downward position, as shown in FIG. 5, the combination sporting practice assembly 108 can serve as a football target or goal, with the basketball hoop 120 serving as a target opening for receiving a thrown football, and/or with the left and rights arms 128 and 130 of the structure 112 each defining a respective one of a pair of field goal uprights to provide a football target or goal. It will be appreciated that, in one embodiment, the basketball hoop 120 might be coupled to the connection portion 122 such that the basketball hoop 120 can be disconnected and not used when the combination sporting practice assembly 108 is in a configuration to facilitate football practice.

Figure 7A:
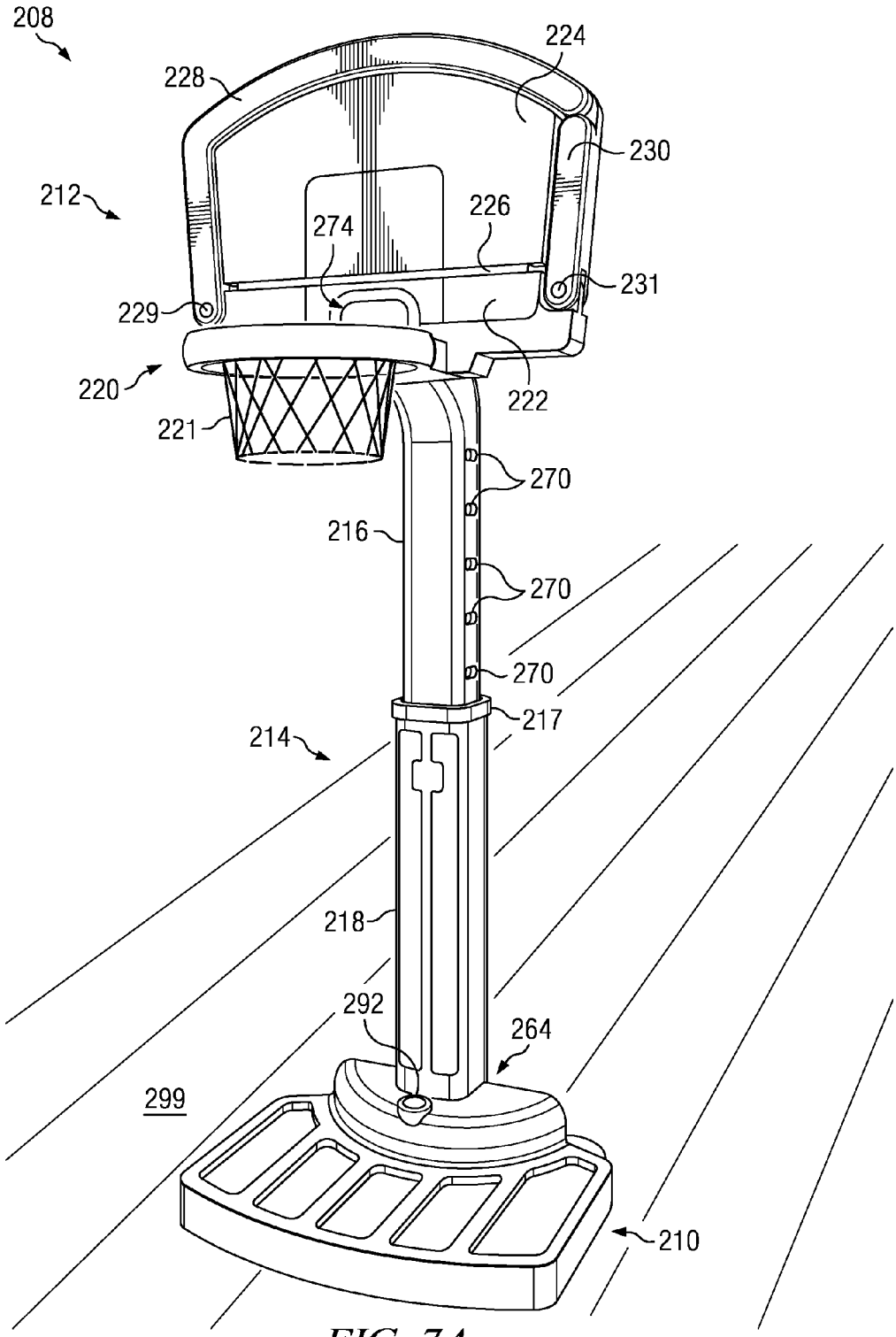
FIG. 7A is a front perspective view depicting a combination sporting practice assembly in accordance with yet another embodiment, wherein the combination sporting practice assembly is in a first configuration.
Figure 7B:
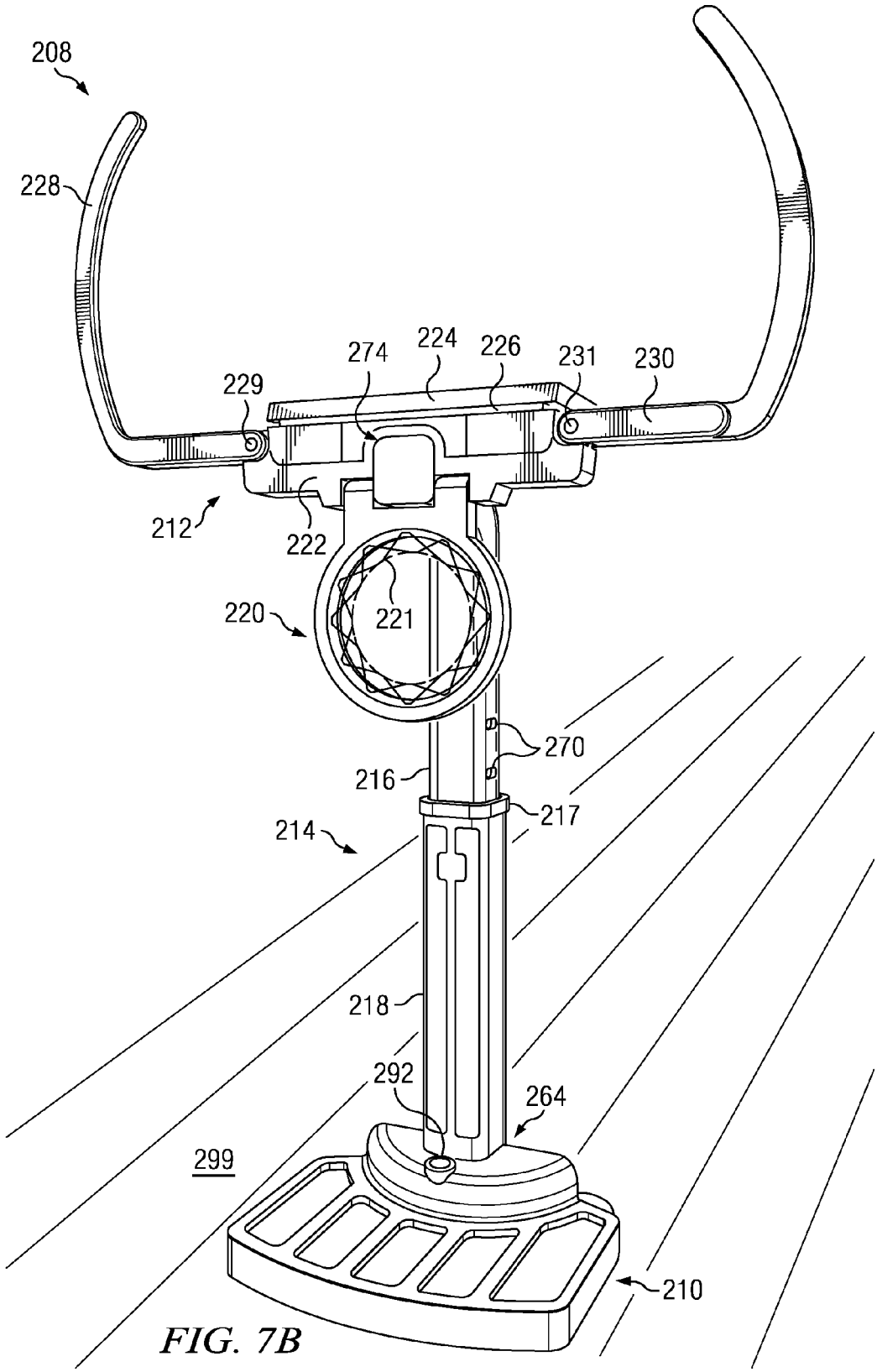
FIG. 7B is a front perspective view depicting the combination sporting practice assembly of FIG. 7A, wherein the combination sporting practice assembly is in a second configuration.

A combination sporting practice assembly 208 in accordance with yet another embodiment is depicted in FIGS. 7A-7B to include structures 210 and 212, a stem 214, and a basketball hoop 220 which can be selectively assembled as shown, for example, in FIGS. 7A-7B. The structure 210 can serve as a lower structure or base for resting and supporting the combination sporting practice assembly 208 upon a ground surface 299 or other outdoor or indoor support surface. The structure 212 can serve as an upper structure which can be selectively reconfigured to alternatively define a basketball backboard and a pair of field goal uprights.

In one embodiment, the structure 210 can include an internal cavity (not shown) which can be selectively filled with a ballast material (e.g., water, gravel or sand) by an operator, such as through a fill aperture 292 in the structure 210. The ballast material can be used to resist inadvertent tipping of the combination sporting practice assembly 208 during use (e.g., as shown and described below with respect to the combination sporting practice assembly 308). When the combination sporting practice assembly 208 is disassembled, an operator can remove the ballast material from the structure 210, such as to facilitate convenient movement or storage of the combination sporting practice assembly 208.

The stem 214 is shown to comprise upper and lower riser members 216 and 218, and to extend between upper and lower ends 274 and 264. The lower riser member 218 of the stem 214 can releasably engage the structure 210, and the upper riser member 216 of the stem 214 can releasably engage the structure 212, such as described above with respect to the combination sporting practice assemblies 8 and 108. The basketball hoop 220 can releasably engage the structure 212 and/or the upper riser member 216 and can be pivotable between upward and downward positions as respectively shown in FIGS. 7A and 7B. It will be appreciated that the removable engagement of the various components of the combination sporting practice assembly 208 can be achieved through use of any of a variety of suitable features or arrangements, such as described above with respect to the combination sporting practice assemblies 8 and 108.

In one embodiment, the stem 214 can further include a collar 217 attached to the lower riser member 218. The upper and lower riser members 216 and 218 can telescopingly engage one another and can be locked relative to one another, such as through use of the collar 217 and channels 270, in multiple different positions such that the height of the structure 212 and the basketball hoop 220 can be moved relative to the structure 210 and the ground surface 299 or other outdoor or indoor support surface, and so that the combination sporting practice assembly 208 can facilitate basketball and football practice by children of differing heights, ages, and athletic abilities, such as described above with respect to the combination sporting practice assemblies 8 and 108. However, a stem can be provided in any of a variety of suitable alternative configurations.

The structure 212 can include a connection portion 222, a generally central portion 224, and left and right arms 228 and 230 which can be pivotally coupled with the connection portion 222 by way of respective pivots 229 and 231. The connection portion 222 can releasably engage the upper riser member 216 of the stem 214. Once assembled, the structure 212 can be selectively reconfigured between first and second configurations. In particular, to facilitate such reconfiguration, the generally central portion 224 and the left and right arms 228 and 230 can each be moved with respect to the connection portion 222 of the structure 212. In particular, the generally central portion 224 of the structure 212 can be hingedly coupled with the connection portion 222 and can be pivotable with respect to the connection portion 222 between an upward position (e.g., shown in FIG. 7A) and a downward position (e.g., shown in FIG. 7B) with respect to the connection portion 222 of the structure 212.

The generally central portion 224 can be pivotally coupled to the connection portion 222 by way of a living hinge 226, as shown in FIG. 7B. The left and right arms 228 and 230 can each be pivotable with respect to the connection portion 222 between respective inward or closed positions (shown in FIG. 7A) and respective outward or opened positions (shown in FIG. 7B). It will be appreciated that a generally central portion or arm can be pivotally or otherwise movably coupled to a connection portion of a structure through use of another type of hinge(s) or pivot(s), and/or in any of a variety of other suitable configurations. In an alternative embodiment, a structure can be configured such that a generally central portion of the structure can be completely disconnected from a corresponding connection portion of the structure.

The generally central portion 224 can be selectively locked or retained in the upward position such as through placement of the left and right arms 228 and 230 in the closed position. In the closed position, respective portions of the left and right arms 228 and 230 can engage and overlap one another (e.g., one in front of the other), and the respective portions of the left and right arms 228 and 230 can be in contacting engagement with one another and a top edge of the generally central portion 224, as shown in FIG. 7A. In this configuration, the left and right arms 228 and 230 each cooperate with the generally central portion 224 to define at least a portion of the basketball backboard. Any of a variety of suitable additional or alternative features can be provided to selectively lock a generally central portion in one or both of an upward position and a downward position.

Once the left and right arms 228 and 230 are moved from the closed position (shown in FIG. 7A) to the opened position (shown in FIG. 7B), respectively, the generally central portion 224 can be moved from its upward position (shown in FIG. 7A) to its downward position (shown in FIG. 7B). In one embodiment, the left and right arms 228, 230, the pivots 229, 231, and/or the connection portion 222 can be provided with one or more stops or other features (not shown) which can be configured to restrict pivoting of the left and right arms 228 and 230 to within a predetermined range, such as for example between the respective closed positions (shown in FIG. 7A) and the respective opened positions (shown in FIG. 7B). In one embodiment, the stops can be provided at or internal to the pivots 229 and 231. However, in another embodiment, the left and right arms 228 and 230 can abut respective shoulders (not shown) defined by the connection portion 222 when the left and right arms 228 and 230 are in outward positions. In either arrangement, the stops can be configured to selectively allow further downward pivoting of the left and right arms 228 and 230, such as to facilitate a breakaway function for preventing tipping of the combination sporting practice assembly 208 when a person hangs upon the left and right arms 228 and 230.

In the first configuration, as shown in FIG. 7A, the combination sporting practice assembly 208 can serve as a basketball target or goal, with the structure 212 serving as a basketball backboard and the basketball hoop 220 serving as a target opening for receiving a basketball. More particularly, the left arm 228 and the right arm 230 can each cooperate with the generally central portion 224 to define at least a portion of the basketball backboard when the generally central portion 224 is in the upward position. In one embodiment, the basketball hoop 220 comprises a net 221. The basketball hoop 220 can be selectively pivotable or detachable with respect to the structure 212 such that the basketball hoop 220 can comprise a breakaway-type basketball hoop so as to minimize the possibility that a person hanging on the basketball hoop will result in collapse or toppling of the combination sporting practice assembly 208.

In the second configuration, as shown in FIG. 7B, the combination sporting practice assembly 208 can serve as a football target or goal. In this configuration, the left and right arms 228 and 230 can define a pair of field goal uprights to provide a football target or goal, such as for receiving a thrown or kicked football (e.g., as a field goal target). The basketball hoop 220 can also serve as a target opening such as for receiving a thrown football. The combination sporting practice assembly 208 can also be selectively reconfigured into a third configuration (not shown) in which the generally central portion 224 is in a downward position (as shown in FIG. 7B) with the left and right arms 228 and 230 in a closed potion (as shown in FIG. 7A). In this third configuration, the structure 212 can define an interior opening (e.g., approximately the size of the generally central portion 224) for receiving a thrown or kicked football, with the interior opening being smaller than the target area defined in the configuration of FIG. 7B. It will be appreciated that, in one embodiment, the basketball hoop 220 might be coupled to the connection portion 222 such that the basketball hoop 220 can be disconnected and not used when the combination sporting practice assembly 208 is in a configuration to facilitate football practice.

FIGS. 8A-8H depict a combination sporting practice assembly 308 in accordance with yet another embodiment. The combination sporting practice assembly 308 is shown to be generally similar to the combination sporting practice assembly 108 of FIGS. 3-6 and described above, except with respect to certain features, some of which are described below. Features of the combination sporting practice assembly 308 are marked with reference numbers beginning with a "3" and can refer to like features of the combination sporting practice assembly 108 which are marked with like reference numbers beginning with a "1".

The combination sporting practice assembly 308 is shown to include structures 310 and 312, a stem 314, and a basketball hoop 320. The structure 310 can serve as a lower structure or base for resting and supporting the combination sporting practice assembly 308 upon a ground surface 399 or other outdoor or indoor support surface. The structure 312 can serve as an upper structure which can be selectively reconfigured to alternatively define a basketball backboard and a pair of field goal uprights.

Figure 8A:
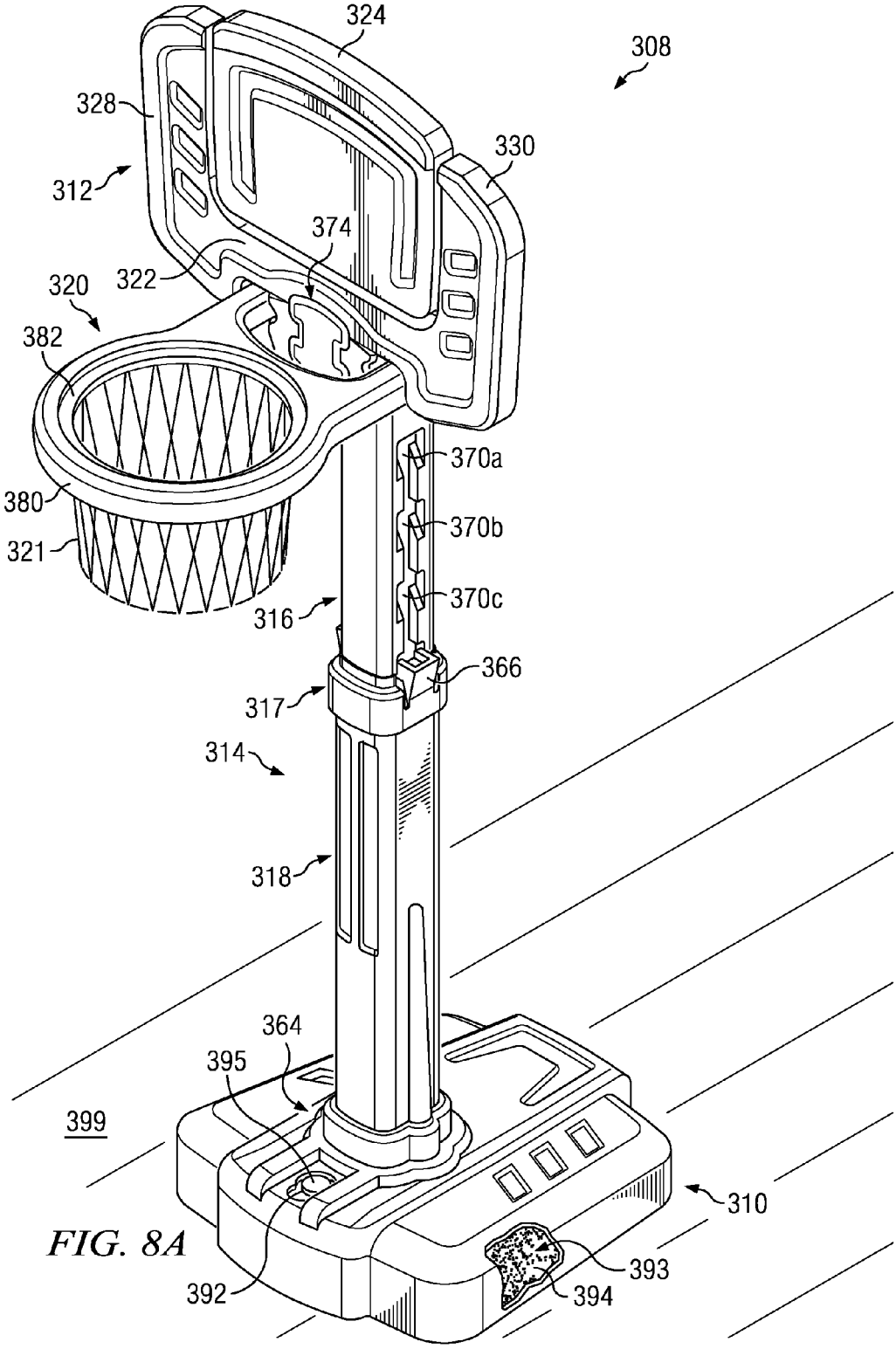
FIG. 8A is a front perspective view depicting a combination sporting practice assembly in accordance with yet another embodiment, wherein a basketball hoop and a generally central portion of the combination sporting practice assembly are in respective upward positions, and wherein a stem of the combination sporting practice assembly is in an extended position, and wherein a portion of a lower structure is shown to be broken away.

The structure 312 can include a connection portion 322, a generally central portion 324, and left and right arms 328 and 330 which can be pivotally coupled with the connection portion 322. In one embodiment, as shown in FIG. 8A, each of the left and right arms 328 and 330 can be stationary with respect to the connection portion 322 and can, for example, be formed as a unitary structure with the connection portion 322. The generally central portion 324 can be selectively locked or retained in an upward position. More particularly, in a first configuration, as shown in FIG. 8A, the left arm 328 and the right arm 330 can each cooperate with the generally central portion 324 to define at least a portion of the basketball backboard when the generally central portion 324 is in the upward position. In a second configuration, when the generally central portion 324 is in the downward position, as shown in FIG. 8C, the combination sporting practice assembly 308 can serve as a football target or goal, with the left and right arms 328 and 330 of the structure 312 each defining a respective one of a pair of field goal uprights to provide a football target or goal (and/or with the basketball hoop 320 in the downward position and serving as a target opening for receiving a thrown football).

Figure 8B:
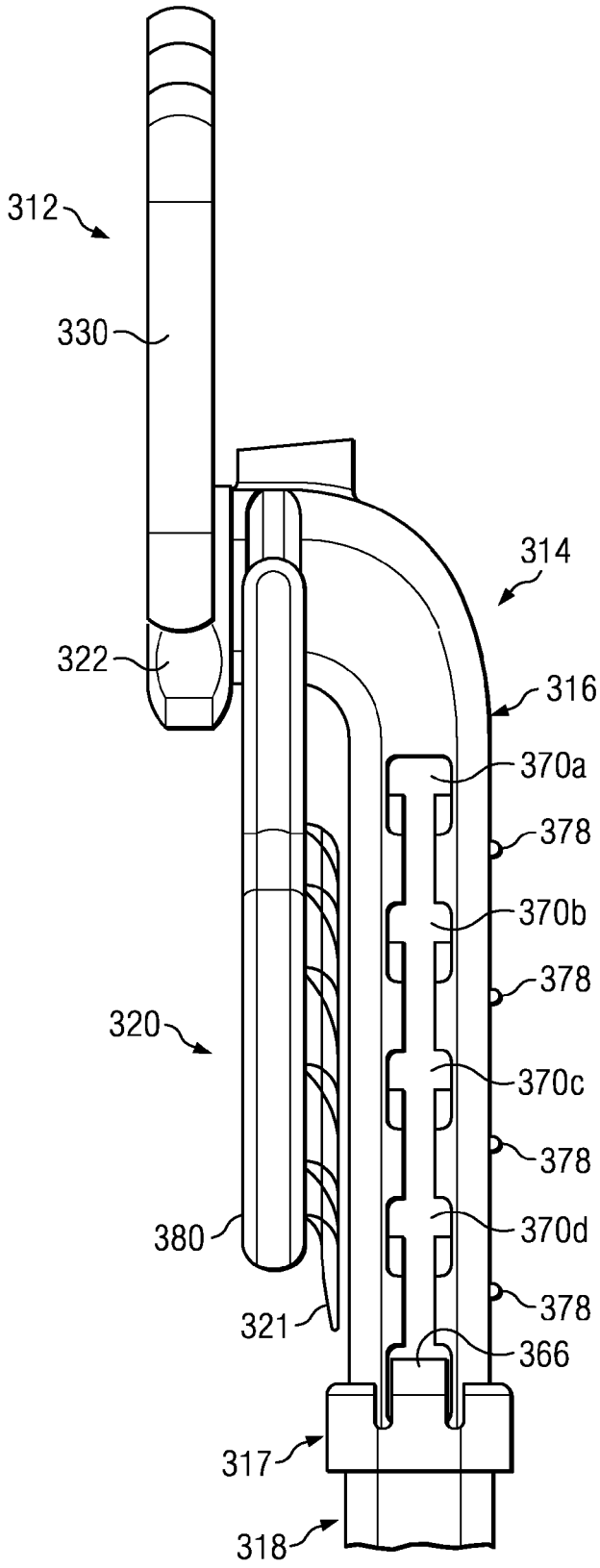
FIG. 8B is a side elevational view depicting a portion of the combination sporting practice assembly of FIG. 8A, wherein the basketball hoop is in a downward position and the generally central portion is in the upward position, and wherein the stem is in an extended position.
Figure 8C:
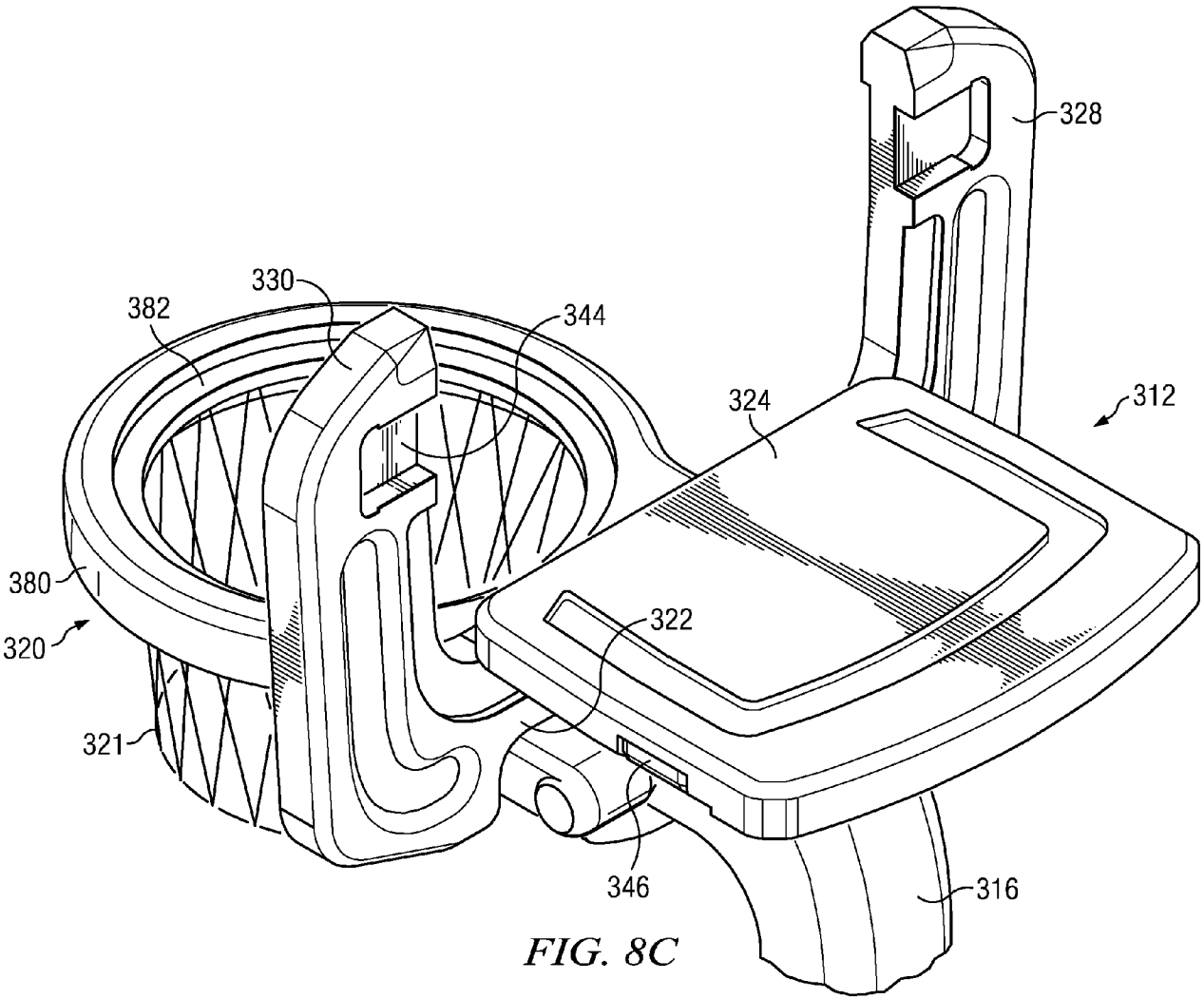
FIG. 8C is a rear perspective view depicting a portion of the combination sporting practice assembly of FIG. 8A, wherein the basketball hoop is in the upward position and the generally central portion is in a downward position.
Figure 8D:
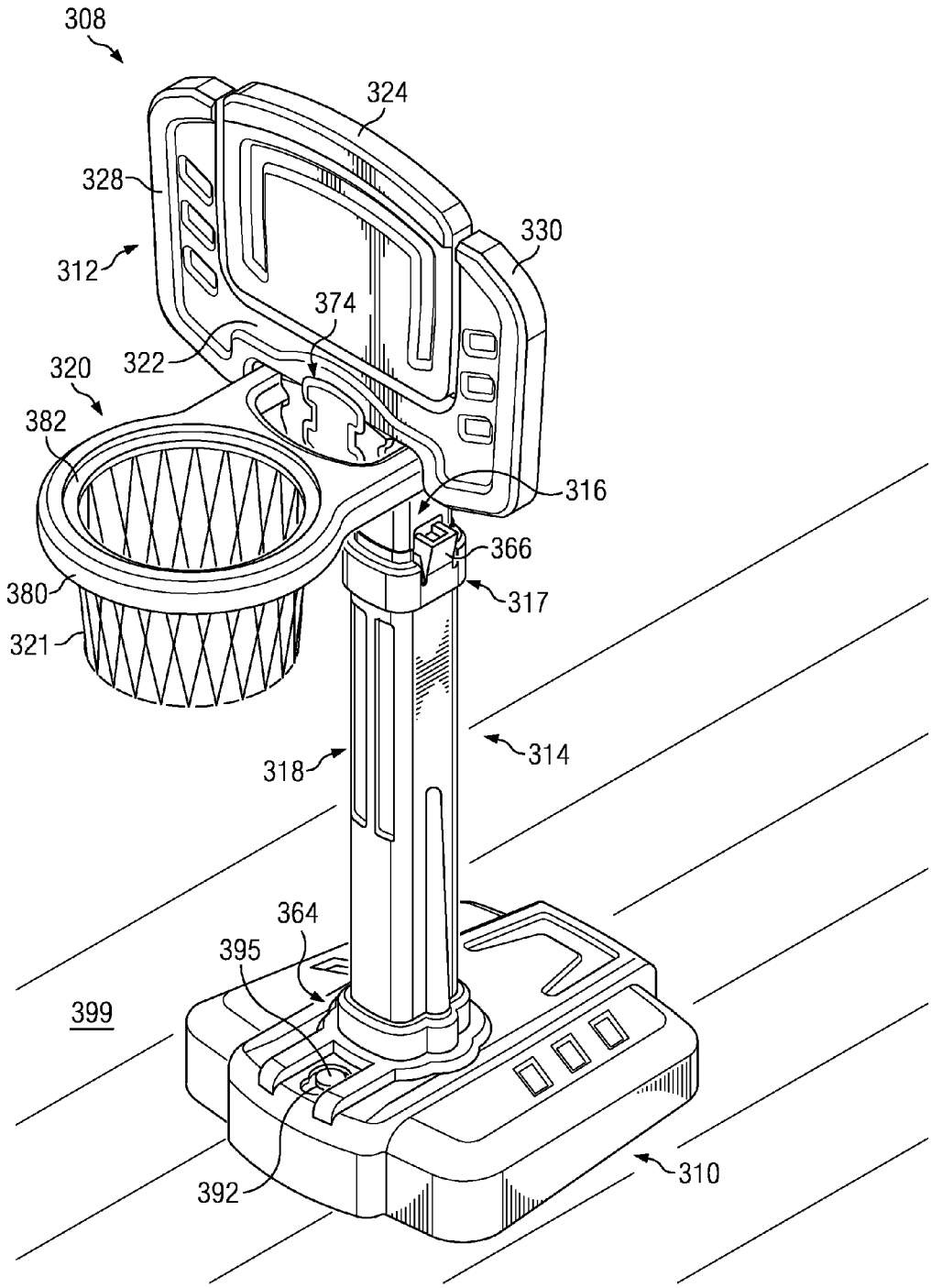
FIG. 8D is a front perspective view depicting the combination sporting practice assembly of FIG. 8A, wherein the basketball hoop and the generally central portion are in the respective upward positions, and wherein the stem is in a collapsed position.
Figure 8E:
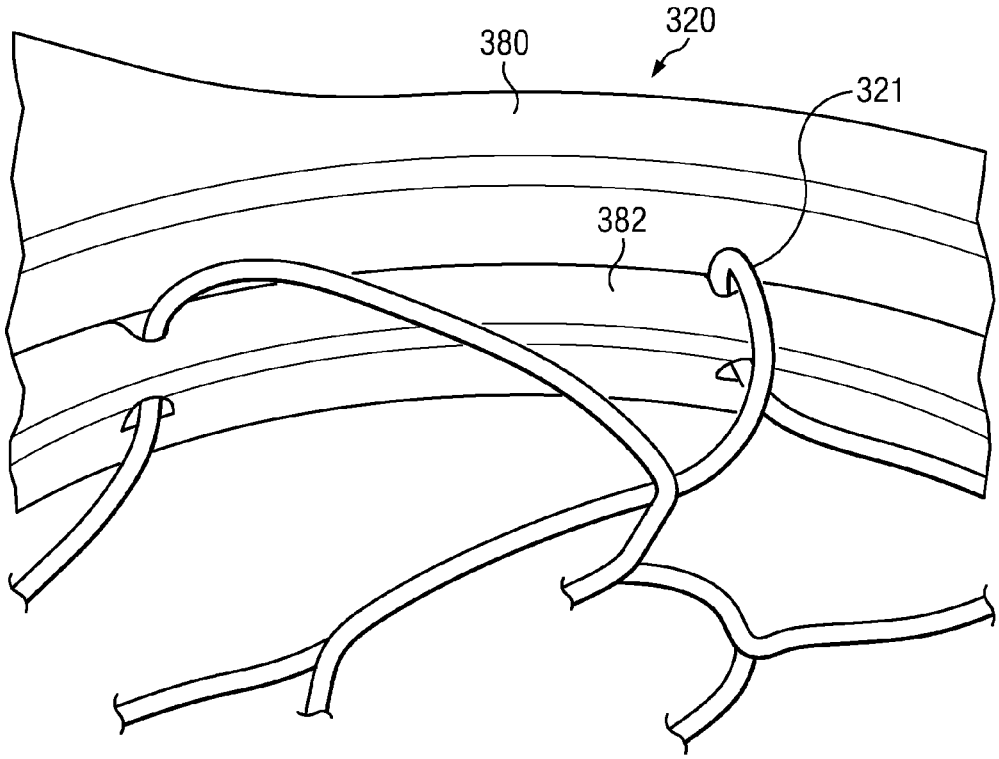
FIG. 8E is a perspective view depicting a portion of the basketball hoop of the combination sporting practice assembly of FIG. 8A.
Figure 8F:
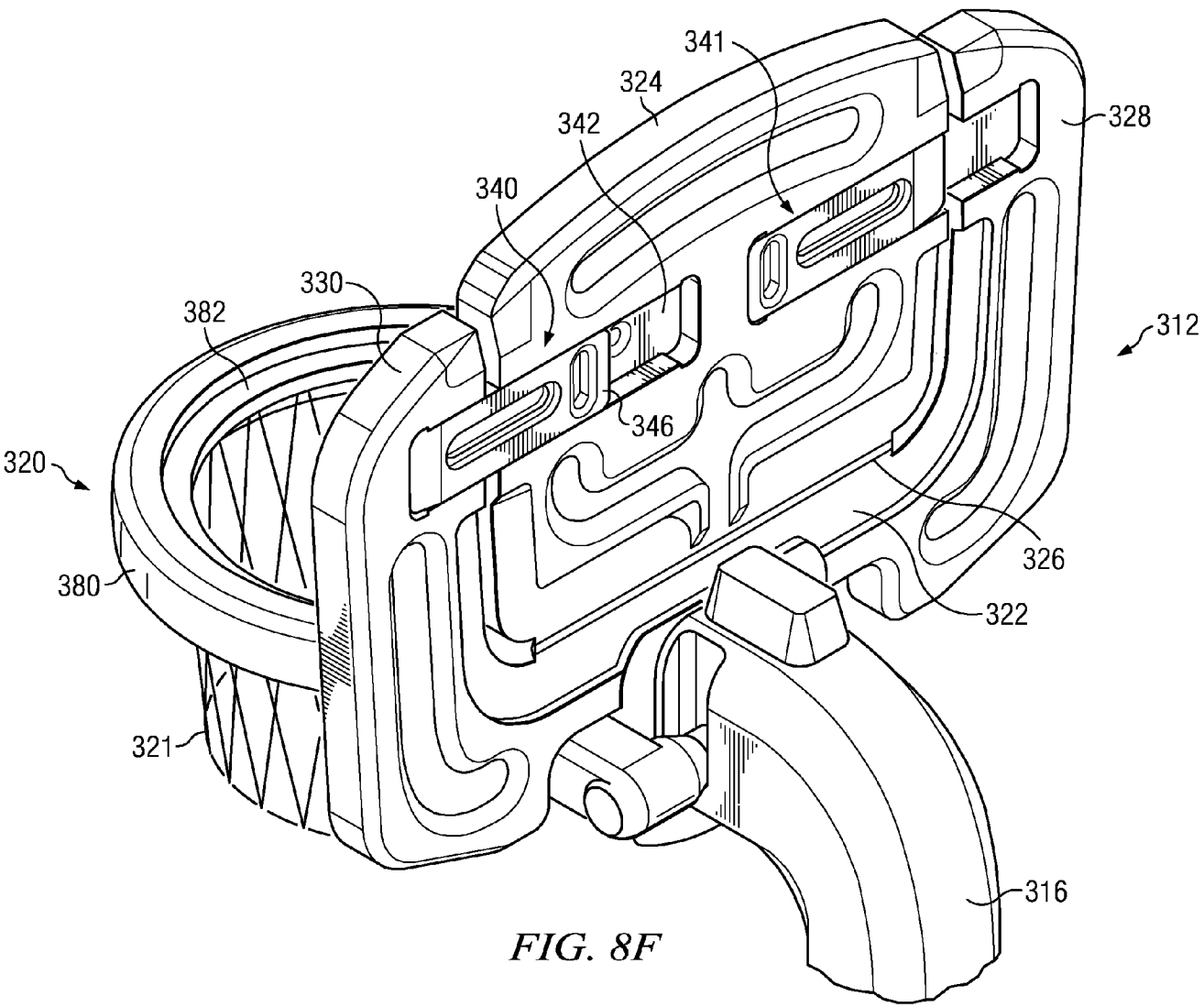
FIG. 8F is a rear perspective view depicting a portion of the combination sporting practice assembly of FIG. 8A, wherein the basketball hoop and the generally central portion are in the respective upward positions, and wherein one lock is locked and another lock is unlocked.

For example, with reference to FIGS. 8C and 8F, the structure 312 can include locks 340 and 341 which can be configured to selectively retain the generally central portion 324 in the upward position. The lock 340 can include a slide member 346 which is at least partially received within a channel 342 formed in the generally centrally portion 324, and which is configured to be selectively partially received within a channel 344 (FIG. 8C) formed in a right arm 330 of the structure 312. The slide member 346 can be injection molded from plastic or can alternatively be formed from metal or any of a variety of other suitable materials. The slide member 346 can be configured to selectively engage the channel 344 to facilitate securement of the generally central portion 324 in the upward position as shown in FIG. 8F. The lock 341 can be similar to the lock 340 and can cooperate with the lock 340 to facilitate securement of the generally central portion 324 in the upward position as shown in FIG. 8F.

More particularly, the slide member 346 can be slideable between a locked position and an unlocked position. The lock 340 is shown in FIG. 8F with its slide member 346 in the locked position, and the lock 341 is shown in FIG. 8F with its slide member in the unlocked position. In the locked position, the slide member of the respective lock 340 and 341 can engage each of the generally central portion 324 and the respective one of the left arm and right arm 328 and 330 to facilitate retention of the generally central portion 324 in the upward position. In the unlocked position, the slide member of the respective lock 340 and 341 can engage only the generally central portion 324, but not either of the left or right arms 328 or 330, to facilitate pivoting of the generally central portion 324. In an alternative embodiment, in the unlocked position, the slide member of a lock can engage only a left or right arm 328 or 330, but not the generally central portion 324, to facilitate pivoting of the generally central portion 324.

When the slide member 346 is fully inserted into the channel 342 (as shown with respect to the lock 340 in FIG. 8C), and the lock 341 is also unlocked, the generally central portion 324 can pivot with respect to a connection portion 322 of the structure 312. However, the slide member 346 can be slid partially from the channel 342 and into channel 344 in the right arm 330, into an engaged position as shown in FIG. 8F, such that the generally central portion 324 can be prevented from pivoting with respect to the connection portion 322 and can be maintained in an upward position. When the locks 340 and 341 are both not engaged, the generally central portion 324 can be free to move to the downward position as shown in FIG. 8C. Any of a variety of suitable additional or alternative locking features can optionally be provided to facilitate selective locking or retention of the generally central portion 324 in the upward and/or downward position.

Figure 8G:
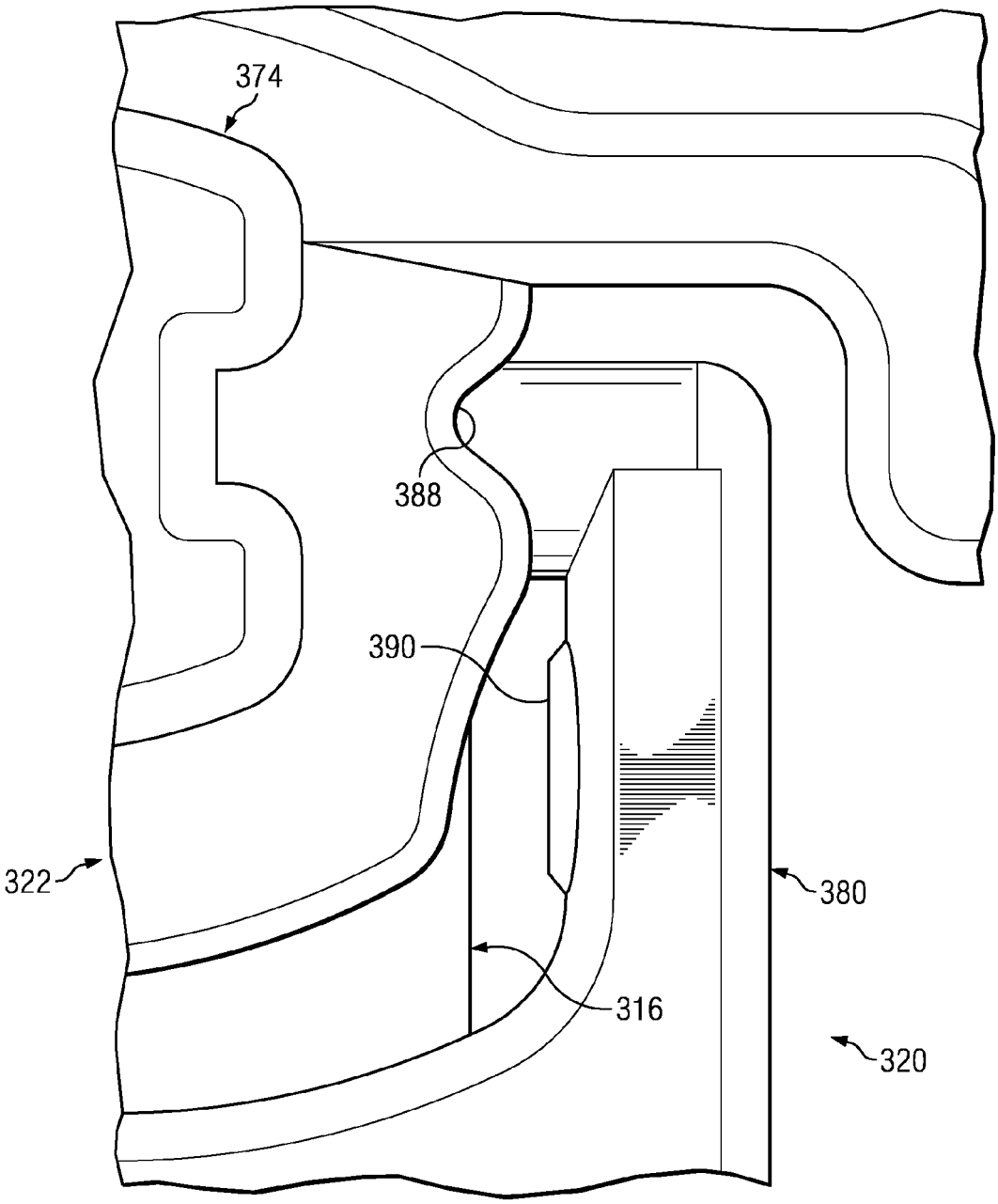
FIG. 8G is a front perspective view depicting a portion of the combination sporting practice assembly of FIG. 8A, wherein the basketball hoop is in the downward position.

The combination sporting practice assembly 308 can include a basketball hoop 320 which can selectively pivot between upward and downward positions with respect to a stem 314 and the connection portion 322 of the structure 312, as respectively shown in FIGS. 8A and 8B. The basketball hoop 320 can interact with the connection portion 322 in a snap-fit, friction fit, or other interlock arrangement such that the basketball hoop 320 can be maintained in the upward position (e.g., see FIG. 8A) until manually moved to the downward position (e.g., see FIG. 8B). In one embodiment, as generally shown in FIG. 8G, mating surfaces 388 and 390 of the respective connection portion 322 and basketball hoop 320 can be configured to selectively engage one another when the basketball hoop 320 is in the upward position in order to maintain the basketball hoop 320 in the upward position. It will be appreciated that, in this configuration, the basketball hoop 320 can interact with the connection portion 322 in a breakaway-type arrangement such that the basketball hoop 320 can remain in the upward position (shown in FIG. 8A) during normal basketball play, but can pivot downwardly (shown in FIG. 8B) when a person hangs upon the basketball hoop 320 so as to prevent tipping of the combination sporting practice assembly 308.

The basketball hoop 320 is shown in FIG. 8E to include a body 380, an insert 382, and a net 321. The body 380 can be releasably engaged with at least one of the stem 314 and the connection portion 322. In one embodiment, the insert 382 can comprise two generally semi-circular portions that can be formed from plastic during an injection molding process. The two generally semi-circular portions can be woven through the net 321 and then placed end to end to form an annular ring, such that portions of the net 321 wrap around the insert 382, as partially shown in FIG. 8E. The insert 382 can be attached (e.g., with press-fit features, screws or other suitable fasteners, adhesives, or otherwise) to the body 380, such that the insert 382 and the body 380 cooperate to sandwich a portion of the net 321. In this configuration, it will be appreciated that the net 321 can be securely fastened to the body 380 so as to render it unlikely that the net 321 will become released from the body 380 during normal use of the combination sporting practice assembly 308 for basketball play.

Figure 8H:
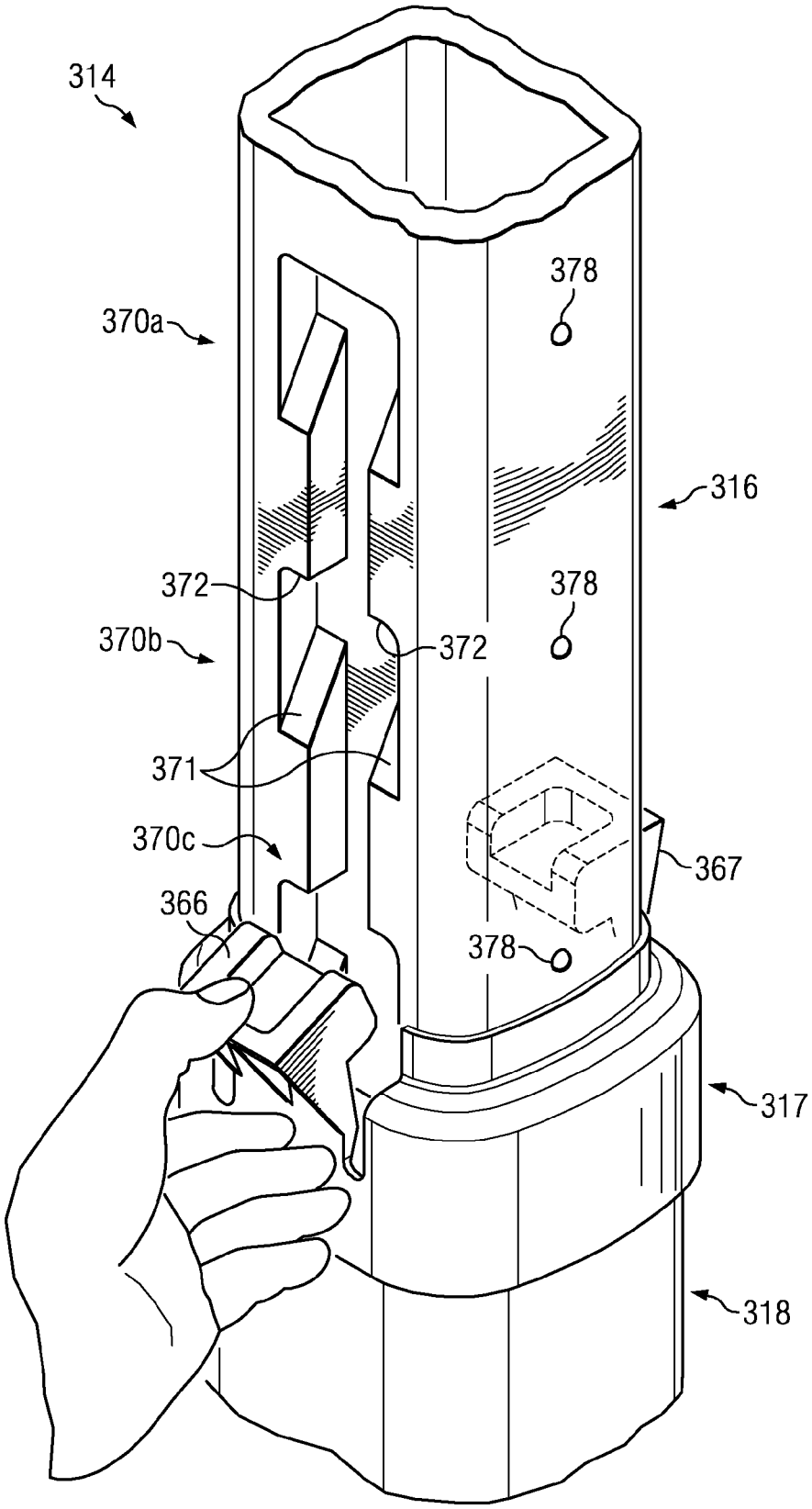
FIG. 8H is a perspective view depicting a portion of the stem of the combination sporting practice assembly of FIG. 8A, wherein the stem is in an extended position, and wherein an operator's hand is shown as withdrawing a pin from a channel in the stem.

The stem 314 is shown in FIG. 8H to include upper and lower riser members 316 and 318 and a collar 317, and to extend between upper and lower ends 374 and 364. The upper riser member 316 is shown in FIG. 8B as bending from a vertical orientation (in which the upper riser member 316 releasably engages the collar 317 and the lower riser member 318) to a horizontal orientation (at which the upper riser member 316 interfaces the structure 312), and thus to be shaped generally like an upside-down "L". In one embodiment, with reference to FIGS. 8A, 8D, and 8G, the end profile of the upper end 374 of the stem 314 can be shaped like an "I" (e.g., such that the upper end 374 can generally resemble an I-beam), and the upper end 374 can be received within a corresponding "I" shaped aperture in the structure 312, such as in an interference fit, to facilitate releasable engagement of the upper riser member 316 to the structure 312. The end profile of the lower end 364 of the stem 314 can have any of a variety of suitable shapes, and the lower end 364 can be received within a correspondingly-shaped aperture in the structure 310, such as in an interference fit, to facilitate releasable engagement of the lower riser member 318 to the structure 310.

In one embodiment, the collar 317 can be formed separately from both of the upper and lower riser members 316 and 318. In another embodiment, the collar 317 can be formed as a unitary structure with one of the upper and lower riser members 316 and 318 of the stem 314. For example, with reference to FIGS. 8A-8B and 8H, the collar 317 can be formed as a unitary structure with the lower riser member 318 and can define pins 366 and 367. The pins 366 and 367 can be formed as a unitary structure with other portions of the collar 317, and can be attached to the remainder of the collar 317 with respective living hinges. The upper riser member 316 can define a plurality of channels 370, certain respective ones of which are individually identified as 370*a*, 370*b*, 370*c* and 370*d* in FIGS. 8A-8B and 8H. Respective ones of the channels 370 can be vertically spaced with respect to other respective ones of the channels 370, as generally shown in FIGS. 8A-8B and 8H.

The collar 317 can be configured to selectively engage any of the channels 370 to facilitate selective locking of the upper riser member 316 with respect to the lower riser member 318 in any of a plurality of respective positions. More particularly, to lock the upper riser member 316 in position with respect to the lower riser member 318, the pins 366 and 367 can be received within respective channels 370 in the upper riser member 316, as generally shown in FIGS. 8A-8B. As shown in FIG. 8H with respect to the pin 366, an operator's hands can be used to manually withdraw the pins 366 and 367 from the respective channels 370 in the upper riser member 316 such as to facilitate lowering of the height of the structure 312.

Upon receipt of the pins 366 and 367, the channels 370 can be configured to prevent unintended collapse of the stem 314. However, the channels 370 can be configured to facilitate automatic movement of the pins 366 and 367 within the channels 370 when the stem 314 is uncollapsed, such that an operator can raise the height of the structure 312 by simply pulling upwardly upon the structure 312 relative to the structure 310 and without touching the pins 366 and 367. To facilitate this operation, each of the channels 370 can include at least one sloped wall (shown as 371 with respect to the channel 370*b* in FIG. 8H) that is configured to selectively contact and facilitate disengagement of the pin 366 of the collar 317 from the respective channel 370 during outward telescoping movement of the upper riser member 316 with respect to the lower riser member 318. Each of the channels 370 can further include at least one end wall (shown as 372 with respect to the channel 370*b* in FIG. 8H) that is configured to selectively abut the pin 366 of the collar 317 for preventing inward telescoping movement of the upper riser member 316 with respect to the lower riser member 318 so long as the pin 366 remains engaged with the respective channel 370.

It will be appreciated that a collar can alternatively be attached to an upper riser member and configured to selectively engage channels in a lower riser member. In an alternative embodiment, instead of being a unitary structure that is attached to a riser member, a collar can be provided as a separate component that is attached to the riser member. In one embodiment, the upper riser member 316 can be provided with a plurality of outwardly extending bumps, ribs, or other protrusions (e.g., 378 in FIGS. 8B and 8H) which can be configured to selectively contact the collar 317 for providing friction during telescoping movement of the upper riser member 316 with respect to the lower riser member 318, in order to prevent rapid and uncontrolled collapse of the stem 314 when the pins 366 and 367 are withdrawn from the channels 370. In another embodiment, a plurality of such outwardly extending bumps, ribs, or other protrusions can be provided upon a lower riser member of a stem.

The structure 310 can serve as a base for resting and supporting the combination sporting practice assembly 308 upon a ground surface 399 or other outdoor or indoor support surface. In one embodiment, with reference to FIG. 8A, the structure 310 can define a fill aperture 392 and an interior cavity 393. The fill aperture 392 can be provided in communication with the interior cavity 393 to facilitate insertion and removal of ballast material 394 (e.g., water, gravel or sand) with respect to the interior cavity 393 by an operator. The ballast material 394 can be used to resist inadvertent tipping of the combination sporting practice assembly 308 during use. When the combination sporting practice assembly 308 is disassembled, an operator can remove the ballast material 394 from the structure 310, such as to facilitate convenient movement or storage of the combination sporting practice assembly 308. In one embodiment, a plug 395, such as can be formed from plastic, can be provided to enable an operator to selectively seal and unseal the fill aperture 392.

FIGS. 9A-9D depict a combination sporting practice assembly 408 in accordance with still another embodiment. Certain features of the combination sporting practice assembly 408 are shown to be generally similar to those of the combination sporting practice assembly 208 as shown in FIGS. 7A-7B, and/or those of the combination sporting practice assembly 308 as shown in FIGS. 8A-8H, and described above, except with respect to certain other features, some of which are described below. Features of the combination sporting practice assembly 408 are marked with reference numbers beginning with a "4" and can refer to like features of one or both of the combination sporting practice assemblies 208 and 308 which are marked with like reference numbers beginning with a "2" or "3", respectively.

The combination sporting practice assembly 408 can include a basketball hoop 420 which can be formed similarly to the basketball hoop 320 discussed above. Also, the combination sporting practice assembly 408 can include a stem 414 which can be formed similarly to the stem 314 discussed above. More particularly, the stem 414 is shown to comprise upper and lower riser members 416 and 418 and a collar 417, and to extend between upper and lower ends 474 and 464. The lower riser member 418 of the stem 414 is generally shown to releasably engage a structure 410, and the upper riser member 416 of the stem 414 is generally shown to engage a structure 412, in a manner similar to that described above with respect to the combination sporting practice assembly 308. In an alternative embodiment, it will be appreciated that upper and lower riser members can engage structures in any of a variety of other suitable arrangements, such as described above with respect to the combination sporting practice assemblies 8, 108, and 208.

The structure 412 of the combination sporting practice assembly 408 can be configured to alternatively define a basketball backboard and a pair of field goal uprights. More particularly, left and right arms 428 and 430 can be pivotally attached to a connection portion 422 of the structure 412 by way of respective pivots 429 and 431 such that the left and right arms 428 and 430 can be moved between respective outward or opened positions (shown in FIG. 9B) and respective inward or closed positions (shown in FIG. 9A). The generally central portion 424 of the structure 412 can be pivotally coupled with the connection portion 422 by way of a living hinge 426 or some other suitable hinge arrangement.

Figure 9A:
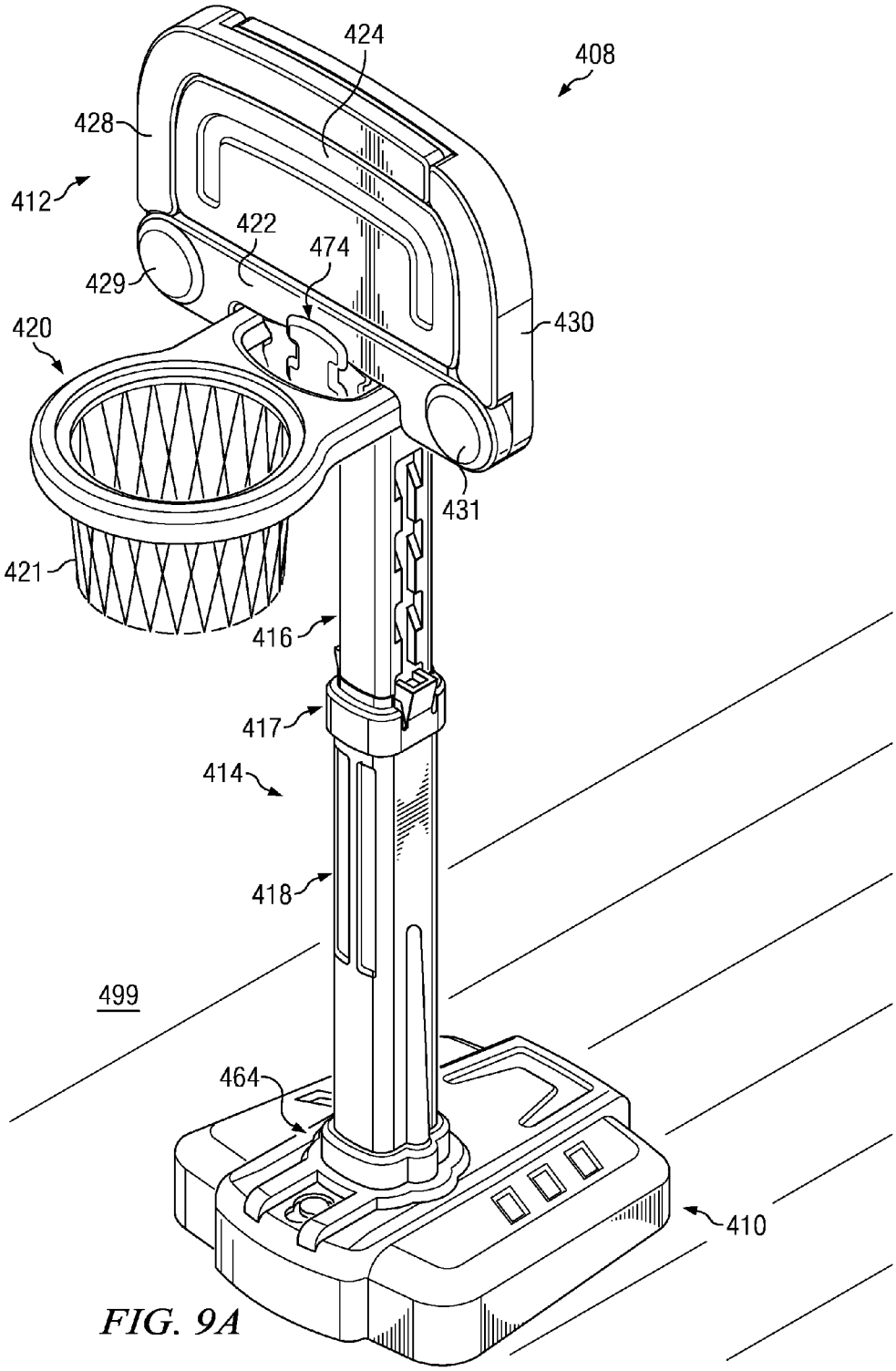
FIG. 9A is a front perspective view depicting a combination sporting practice assembly in accordance with still another embodiment, wherein a basketball hoop and a generally central portion of the combination sporting practice assembly are in respective upward positions, left and right arms of the combination sporting practice assembly are in respective inward positions, and a stem of the combination sporting practice assembly is in an extended position.
Figure 9B:
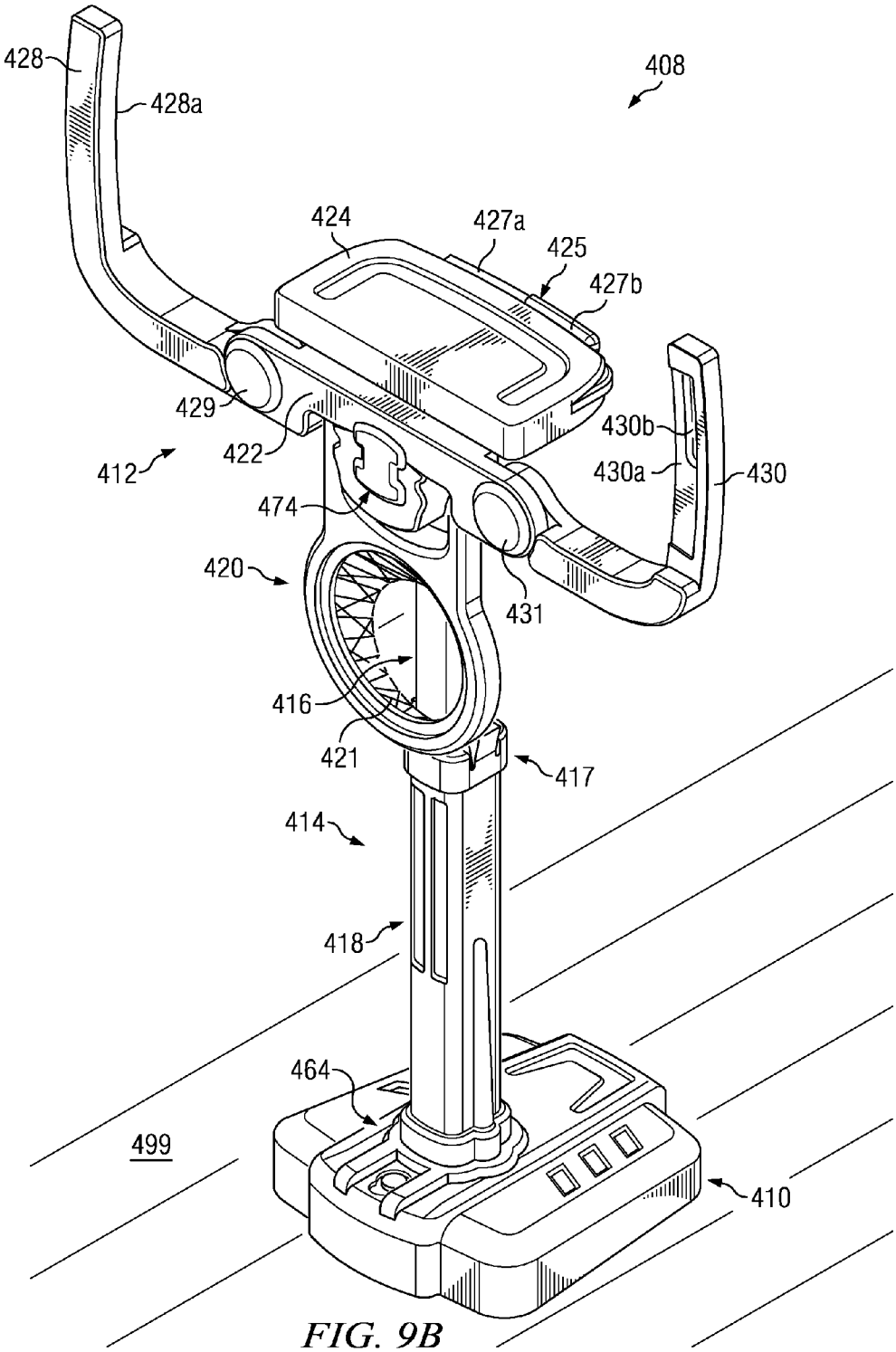
FIG. 9B is a front perspective view depicting the combination sporting practice assembly of FIG. 9A, wherein the basketball hoop and the generally central portion are in respective downward positions, the left and right arms are in respective outward positions, and the stem is in the extended position.
Figure 9C:
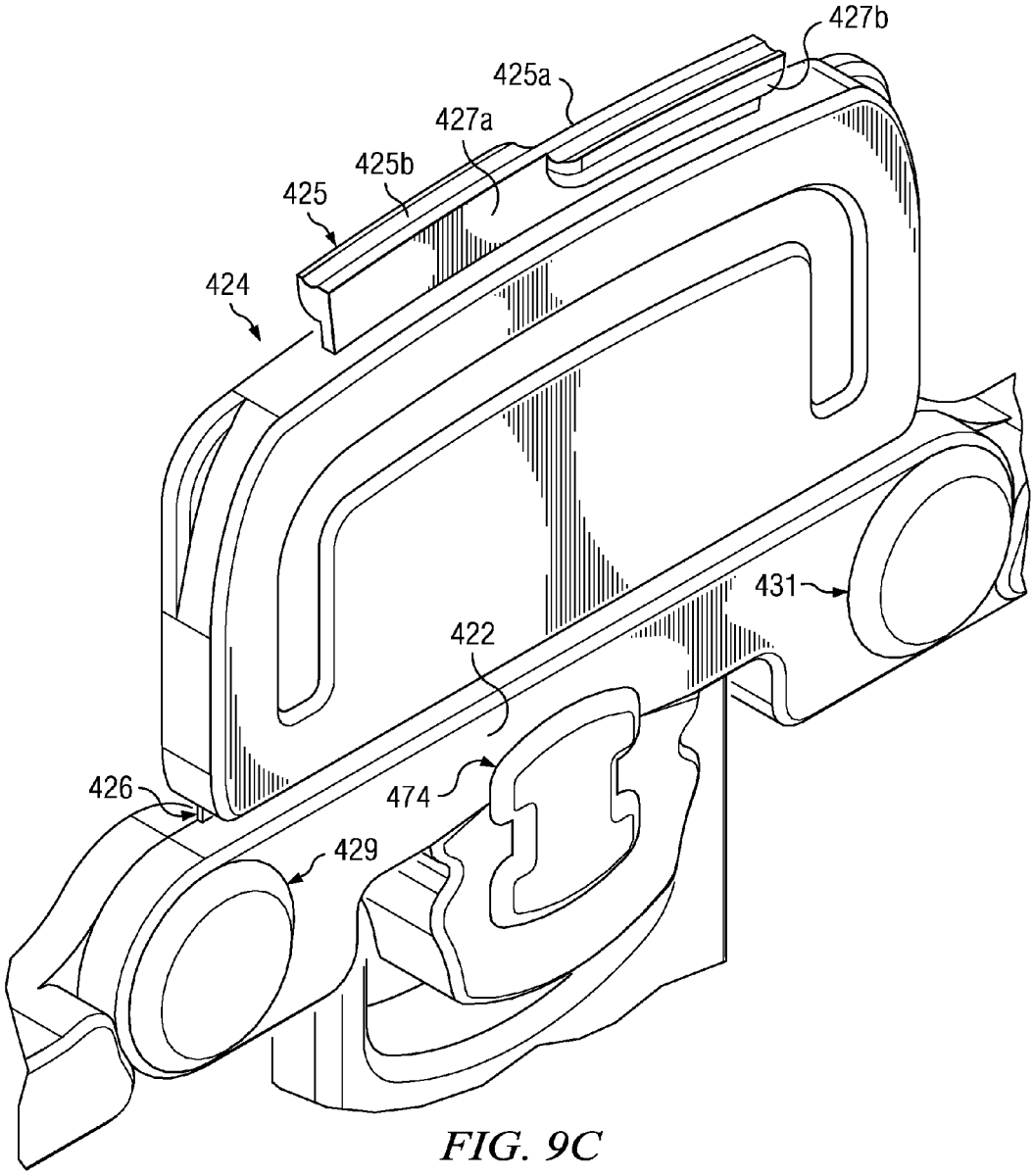
FIG. 9C is an enlarged front perspective view depicting a portion of the combination sporting practice assembly of FIG. 9A, wherein the basketball hoop is in a downward position, the generally central portion is in the upward position, and the left and right arms are in respective outward positions.

The generally central portion 424 can include an extension 425 which can selectively engage (e.g., in a snap-fit, friction fit, or other interlock) and retain the left and right arms 428 and 430 of the combination sporting practice assembly 408 when the left and right arms 428 and 430 are in closed positions, as will be appreciated with reference to FIGS. 9A-9C. More particularly, in one embodiment, as shown in FIGS. 9B-9C, the extension 425 can include a surface 425*a* and an interlocking portion 425*b* that can respectively contact a corresponding surface 430*a* and interlocking portion 430*b* of the right arm 430. Likewise, the extension 425 can include a surface 427*a* and an interlocking portion 427*b* that can respectively contact a corresponding surface 428*a* and interlocking portion (not shown) of the left arm 428. Accordingly, in the configuration of FIG. 9A, the left arm 428 and the right arm 430 can each engage both one another and the generally central portion 424 to retain the generally central portion 424 in the upward position when the generally central portion 424 is in the upward position with the left arm 428 and the right arm 430 in the respective inward positions. In this configuration, the left and right arms 428 and 430 can each cooperate with the generally central portion 424 to define at least a portion of the basketball backboard.

The left arm 428 and the right arm 430 can each define a respective one of a pair of field goal uprights when the generally central portion 424 is in the downward position with the left arm 428 and the right arm 430 in the respective outward positions. When the left and right arms 428 and 430 are in the outward positions such as to provide a field goal target (shown in FIG. 9B), the pivots 429 and 431 can be configured to allow further downward pivoting of the left and right arms 428 and 430 such as to facilitate a breakaway function for preventing tipping of the combination sporting practice assembly 408 when a person hangs upon the left and right arms 428 and 430.

Figure 9D:
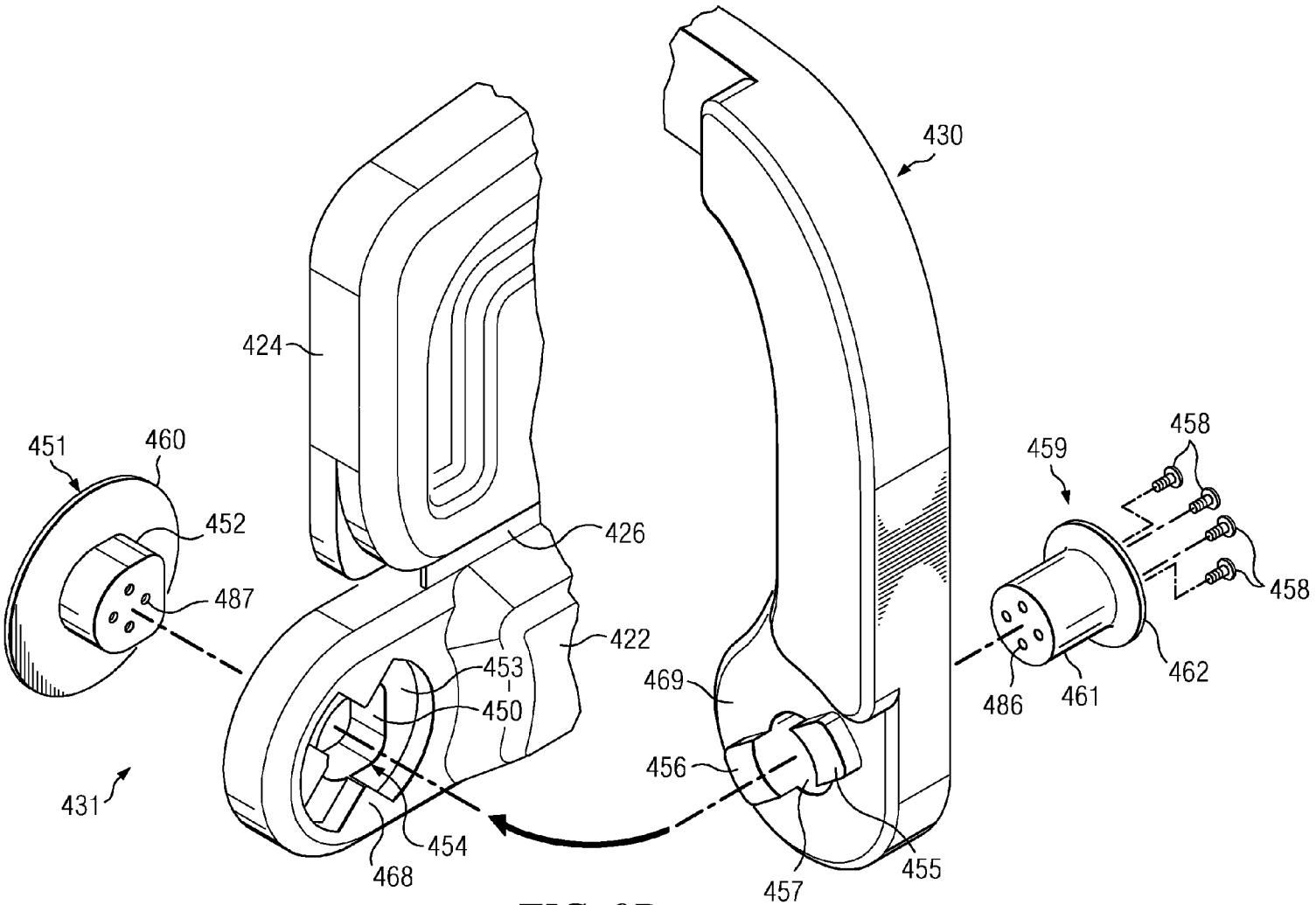
FIG. 9D is an exploded perspective view depicting portions of the combination sporting practice assembly of FIG. 9A, wherein the generally central portion is in the upward position.

The pivots 429 and 431 can have any of a variety of suitable mechanical configurations. For example, portions of the combination sporting practice assembly 408 are depicted in FIG. 9D in an exploded arrangement to illustrate one possible configuration of the pivot 431. In particular, a front cover 451 is shown to define an end portion 460 and an extension portion 452. The extension portion 452 can be received within an opening 450 in the connection portion 422 and can have a shape corresponding to that of the opening 450 such that, when the extension portion 452 is inserted into the opening 450, the front cover 451 is not rotatable relative to the connection portion 422. The right arm 430 is shown in FIG. 9D to define an aperture 457 and to comprise protruding members 455 and 456 generally adjacent to the aperture 457. A rear cover 459 is shown to define an end portion 462 and an extension portion 461. The extension portion 461 can be received within the aperture 457 in the right arm 430 such that, when screws 458 are inserted through corresponding apertures (e.g., 486) in the rear cover 459 and into corresponding threaded apertures (e.g., 487) in the front cover 451, a surface 468 of the connection portion 422 can engage a surface 469 of the right arm 430, and the connection portion 422 and the right arm 430 can be sandwiched together by and between the end portions 460 and 462 of the respective front and rear covers 451 and 459.

When so assembled, the protruding members 455 and 456 of the right arm 430 can be received within a recessed area 454 defined by a wall 453 of the connection portion 422, and can selectively contact the wall 453 to restrict pivoting of the right arm 430 beyond a predetermined range. It will be appreciated that the protruding members 455 and 456, the wall 453, and the recessed area 454 can be dimensioned and configured to interact with one another so as to require an application of a force to the right arm 430 to enable the right arm 430 to move from either the inward position (e.g., as in FIG. 9A) to the outward position (e.g., as in FIG. 9B), or from the outward position (e.g., as in FIG. 9B) to the inward position (e.g., as in FIG. 9A), and/or to require an application of an even greater force to the right arm 430 to enable the right arm 430 to move from the outward position (e.g., as in FIG. 9B) to an even lower, breakaway position (not shown, such as to prevent tipping as described above). It will be appreciated that the pivot 429 can have a configuration similar to that of the pivot 431. In other embodiments, it will be appreciated that respective pivots of a combination sporting practice assembly can have other configurations, and/or can have differing configurations with respect to one another.

The respective configurations of a combination sporting practice assembly (e.g., 8, 108, 208, 308, 408) provide multiple sporting arrangements for a child to play with and can also help teach and build a child's hand/eye coordination. In addition, a combination sporting practice assembly (e.g., 8, 108, 208, 308, 408) can be easily converted between or among respective configurations, thus making it easy for any child to practice either sport. Unlike conventional toy sporting devices, the combination sporting practice assembly provides at least two practice devices in one toy, thus providing greater flexibility and options for play and practice, and providing cost savings and storage efficiencies. It will be appreciated that a combination sporting practice assembly such as to selectively and alternatively facilitate basketball practice and football practice can be provided in any of a variety of suitable alternative configurations.

In one embodiment, one or more of the components of the combination sporting practice assembly (e.g., 8, 108, 208, 308, 408), including for example the structures (e.g., 10, 12; 110, 112; 210, 212; 310, 312; and 410, 412), the stem (e.g., 14, 114, 214, 314, 414), and the basketball hoop (e.g., 20, 120, 220, 320, 420) can be formed from plastic such as from a rotomolding, injection molding, or blow molding process. In another embodiment, one or more components of a combination sporting practice assembly can be formed from one or more materials other than plastic. It will also be appreciated that the specific shapes, styles, color, and proportions of the various components of a combination sporting practice assembly can differ from those depicted in FIGS. 1-6, 7A-7B, 8A-8H, and 9A-9C. It will also be appreciated that features or functionalities described above with respect to one or more of the combination sporting practice assemblies (e.g., 8, 108, 208, 308, 408) can apply to any of the combination sporting practice assemblies (e.g., 8, 108, 208, 308, 408) as appropriate.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A combination sporting practice assembly, comprising:

a stem extending between an upper end and a lower end;

an upper structure comprising a left arm, a right arm, a connection portion, and a generally central portion, the connection portion releasably engaged with the upper end of the stem, and the generally central portion being hingedly coupled with the connection portion and pivotable with respect to the connection portion between an upward position and a downward position;

a lower structure releasably engaged with the lower end of the stem and configured to rest upon a ground surface; and a basketball hoop releasably engaged with at least one of the upper end of the stem and the upper structure; wherein:

the generally central portion defines at least a portion of a basketball backboard when the generally central portion is in the upward position; and the upper structure is configured to selectively define a pair of field goal uprights.

2. The combination sporting practice assembly of claim 1 wherein:

the stem comprises an upper riser member and a lower riser member; and the upper riser member is telescopingly engaged with the lower riser member and is selectively lockable in a plurality of respective positions.

3. The combination sporting practice assembly of claim 2 wherein:

the stem further comprises a collar attached to one of the upper riser member and the lower riser member;

the other of the upper riser member and the lower riser member defines a plurality of vertically spaced channels;

the collar is configured to selectively engage any of the channels to facilitate selective locking of the upper riser member with respect to the lower riser member in any of the plurality of respective positions.

4. The combination sporting practice assembly of claim 3 wherein:

at least some of the channels each comprise a sloped wall, the sloped wall being configured to selectively contact and facilitate disengagement of the collar from the respective channel during outward telescoping movement of the upper riser member with respect to the lower riser member; and the at least some of the channels each further comprises an end wall, the end wall being configured to selectively abut the collar for preventing inward telescoping movement of the upper riser member with respect to the lower riser member so long as the collar remains engaged with the respective channel.

5. The combination sporting practice assembly of claim 3 wherein the other one of the upper riser member and the lower riser member defines a plurality of outwardly extending bumps configured to selectively contact the collar for providing friction during telescoping movement of the upper riser member with respect to the lower riser member.

6. The combination sporting practice assembly of claim 1 wherein:

the lower structure defines a fill aperture and an interior cavity; and the fill aperture is in communication with the interior cavity to facilitate insertion and removal of ballast material with respect to the interior cavity.

7. The combination sporting practice assembly of claim 1 wherein:

each of the left arm and the right arm are stationary with respect to the connection portion;

the left arm and the right arm each define a respective one of the pair of field goal uprights when the generally central portion is in the downward position; and the left arm and the right arm each cooperate with the generally central portion to define at least a portion of the basketball backboard when the generally central portion is in the upward position.

8. The combination sporting practice assembly of claim 7 further comprising a slide member configured to facilitate selective retention of the generally central portion in the upward position.

9. The combination sporting practice assembly of claim 8 wherein the slide member is slideable between:

a locked position in which the slide member engages each of the generally central portion and one of the left arm and the right arm to facilitate retention of the generally central portion in the upward position; and an unlocked position in which the slide member engages only one of the generally central portion and the one of the left arm and the right arm to facilitate pivoting of the generally central portion to the downward position.

10. The combination sporting practice assembly of claim 1 wherein:

each of the left arm and the right arm are pivotally coupled to the connection portion and are pivotable with respect to the connection portion between respective inward positions and respective outward positions;

the left arm and the right arm each define a respective one of the pair of field goal uprights when the generally central portion is in the downward position with the left arm and the right arm in the respective outward positions; and the left arm and the right arm each cooperate with the generally central portion to define at least a portion of the basketball backboard when the generally central portion is in the upward position with the left arm and the right arm in the respective inward positions.

11. The combination sporting practice assembly of claim 10 wherein the left arm and the right arm each engage both one another and the generally central portion to retain the generally central portion in the upward position when the generally central portion is in the upward position with the left arm and the right arm in the respective inward positions.

12. The combination sporting practice assembly of claim 1 wherein the basketball hoop is pivotable with respect to the stem between an upward position and a downward position.

13. The combination sporting practice assembly of claim 1 wherein:

the basketball hoop comprises a body, an insert, and a net;

the body is releasably engaged with at least one of the stem and the connection portion; and the insert and the body cooperate to sandwich a portion of the net.

14. A combination sporting practice assembly, comprising:

a structure configured for resting upon a ground surface;

a stem extending between an upper end and a lower end, the lower end releasably engaged with the structure;

a basketball hoop; and means for alternatively defining a basketball backboard and a pair of field goal uprights, said means releasably engaged with the upper end of the stem and comprising a generally central portion and a connection portion;

wherein the generally central portion is hingedly coupled with the connection portion and is pivotable with respect to the connection portion between an upward position and a downward position.

15. A combination sporting practice assembly, comprising:

a stem extending between a first end and a second end;

a first structure releasably engaged with the first end of the stem;

a second structure releasably engaged with the second end of the stem; and a basketball hoop releasably engaged with at least one of the stem, the first structure, and the second structure; and being selectively reconfigurable between:

a first configuration in which one of the first structure and the second structure is configured to rest upon a ground surface, and the other of the first structure and the second structure defines a basketball backboard; and a second configuration in which one of the first structure and the second structure is configured to rest upon a ground surface, and the other of the first structure and the second structure defines a pair of field goal uprights;

wherein:

the other of the first structure and the second structure comprises a left arm, a right arm, a connection portion, and a generally central portion;

the connection portion is releasably engaged with the stem; and the generally central portion is hingedly coupled with the connection portion and is pivotable with respect to the connection portion between an upward position and a downward position; and the generally central portion defines at least a portion of the basketball backboard when the generally central portion is in the upward position.

16. The combination sporting practice assembly of claim 15 wherein:

each of the left arm and the right arm are stationary with respect to the connection portion;

the left arm and the right arm each define a respective one of the pair of field goal uprights when the generally central portion is in the downward position; and the left arm and the right arm each cooperate with the generally central portion to define at least a portion of the basketball backboard when the generally central portion is in the upward position.

17. The combination sporting practice assembly of claim 15 wherein:

each of the left arm and the right arm are pivotally coupled to the connection portion and are pivotable with respect to the connection portion between respective inward positions and respective outward positions;

the left arm and the right arm each define a respective one of the pair of field goal uprights when the generally central portion is in the downward position with the left arm and the right arm in the respective outward positions; and the left arm and the right arm each cooperate with the generally central portion to define at least a portion of the basketball backboard when the generally central portion is in the upward position with the left arm and the right arm in the respective inward positions.

* * * * *

UNITED STATES PATENT AND TRADEMARK OFFICE

CERTIFICATE OF CORRECTION

PATENT NO. : 8,221,270 B1
APPLICATION NO. : 12/796271
DATED : July 17, 2012
INVENTOR(S) : Frank C. Kraska et al.

It is certified that error appears in the above-identified patent and that said Letters Patent is hereby corrected as shown below:

Title Page 1, Section (75) Inventors, line 3, change "Daniel Hladky" to --Daniel Joseph Hladky--;
Title Page 1, Section (75) Inventors, line 5, change "Michael Feeney" to --Michael John Feeney--;
Title Page 1, Section (75) Inventors, line 6, change "Michael Carnahan" to --Michael T. Carnahan--; and
Claim 15, column 18, line 60, delete "and".

Signed and Sealed this
Eleventh Day of September, 2012

David J. Kappos

David J. Kappos
*Director of the United States Patent and Trademark Office*